US011530510B2

(12) United States Patent
Ye et al.

(10) Patent No.: US 11,530,510 B2
(45) Date of Patent: Dec. 20, 2022

(54) SYSTEM IRON

(71) Applicant: LG ELECTRONICS INC., Seoul (KR)

(72) Inventors: Sungmin Ye, Seoul (KR); Jiyeon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1 day.

(21) Appl. No.: 17/399,235

(22) Filed: Aug. 11, 2021

(65) Prior Publication Data

US 2021/0404112 A1 Dec. 30, 2021

Related U.S. Application Data

(63) Continuation of application No. 16/474,645, filed as application No. PCT/KR2017/015704 on Dec. 29, 2017, now Pat. No. 11,111,625.

(30) Foreign Application Priority Data

Dec. 30, 2016 (KR) ..... 10-2016-0184191

(51) Int. Cl.

| | |
|---|---|
| ***D06F 81/08*** | (2006.01) |
| ***D06F 73/00*** | (2006.01) |
| ***D06F 81/04*** | (2006.01) |
| *D06F 1/04* | (2006.01) |

(52) U.S. Cl.

CPC ..... *D06F 81/08* (2013.01); *D06F 73/00* (2013.01); *D06F 81/04* (2013.01)

(58) Field of Classification Search

CPC ..... D06F 81/00; D06F 81/02; D06F 81/04; D06F 81/08; D06F 81/10; D06F 81/12; D06F 73/00; D06F 79/06

See application file for complete search history.

(56) References Cited

U.S. PATENT DOCUMENTS 2,593,937 A 4/1952 Tiller
4,199,088 A * 4/1980 Sanko ..... D06F 73/00 223/67

(Continued)

FOREIGN PATENT DOCUMENTS

DE 19516219 11/1996
DE 19754027 A1 * 6/1999 ..... D06F 71/22

(Continued)

OTHER PUBLICATIONS

European Search Report dated Jul. 21, 2020, on European Patent Application No. 17886622.4.

(Continued)

*Primary Examiner* — Ismael Izaguirre

(74) *Attorney, Agent, or Firm* — Birch, Stewart, Kolasch & Birch, LLP

(57) ABSTRACT

A system iron includes a body. The body includes therein a steam generator for generating steam and an ironing plate, which is rotatably coupled to an upper portion of the body. The ironing plate includes therein steam nozzles for spraying the steam generated by the steam generator to an outside, a first fan for discharging air to the outside of the ironing plate or sucking air into the ironing plate, and a second fan for cooling an iron placed on the ironing plate.

10 Claims, 18 Drawing Sheets

(56) References Cited

U.S. PATENT DOCUMENTS

| | | | | |
|---|---|---|---|---|
| 5,433,034 | A | 7/1995 | Bernstein | |
| 6,807,758 | B2 | 10/2004 | Di Leta | |
| 7,594,597 | B2 * | 9/2009 | Uchikoshi | D06F 71/20 223/73 |
| 8,266,830 | B2 | 9/2012 | Ma | |
| 8,763,284 | B1 * | 7/2014 | Falcone | D06F 81/12 38/139 |
| 2005/0005481 | A1 | 1/2005 | Muljadi | |
| 2006/0107558 | A1 | 5/2006 | Docker | |
| 2010/0043260 | A1 | 2/2010 | Janakiraman | |
| 2010/0242317 | A1 | 9/2010 | Trowsdale et al. | |
| 2012/0006863 | A1 * | 1/2012 | Uchikoshi | D06F 71/20 223/66 |
| 2016/0047083 | A1 | 2/2016 | Yoo | |

FOREIGN PATENT DOCUMENTS

| | | |
|---|---|---|
| DE | 10106329 | 8/2002 |
| JP | H05-337298 | 12/1993 |
| KR | 10-2004-0063896 | 7/2004 |
| KR | 10-2013-0124350 | 11/2013 |
| KR | 10-2015-0011689 | 2/2015 |
| WO | WO 2006057026 A1 | 6/2006 |

OTHER PUBLICATIONS

PCT Search Report dated May 4, 2018, on PCT International Patent Application No. PCT/KR2017/015704.

* cited by examiner

SYSTEM IRON

CROSS-REFERENCE TO RELATED APPLICATIONS

This application is a continuation of U.S. patent application Ser. No. 16/474,645, filed Jun. 28, 2019, which is the U.S. National Phase entry under 35 U.S.C. § 371 from PCT International Application No. PCT/KR2017/015704, filed Dec. 29, 2017, which claims priority to Korean Application No. 10-2016-0184191, filed Dec. 30, 2016, the contents of all of which are incorporated herein by reference in their entireties.

TECHNICAL FIELD

The present application relates to a system iron, and more particularly to a system iron including a fan.

BACKGROUND

In wrinkle removal from clothing, there are the case in which ironing using an iron is required and the case in which garment steaming is required, depending on the type of clothing. However, there is a problem in that wrinkle removal is troublesome because different devices have to be used as needed.

In addition, there is also a problem in which a top such as a dress shirt, which is closed by buttons, has to be buttoned up again on a garment steamer before being held on the garment steamer in the case of performing garment steaming.

Although Korean Unexamined Patent Publication Nos. 10-2016-0066224 and 10-2012-0018486 disclose steaming apparatuses in which steam is sprayed inside clothing, there is a problem in that the steaming apparatuses cannot perform an ironing operation using an iron.

In addition, although consumers are desiring to perform ironing in the state in which a garment placed on an ironing plate is in close contact with the ironing plate, to perform ironing in the state in which the garment is spaced apart from the ironing plate by a predetermined distance when there is a concern of damage to the garment, and to rapidly cool an iron placed on the ironing plate, there is a problem in that the disclosures disclosed in these patent documents cannot efficiently satisfy these needs.

RELATED DOCUMENTS

Korean Unexamined Patent Publication No. 10-2016-0066224A

Korean Unexamined Patent Publication No. 10-2012-0018486A

Technical Problem

An object of the present disclosure is to provide a system iron capable of performing a wrinkle removal operation in various ways.

Another object is to provide a system iron, which has fans that are configured, disposed and operated so as to be optimized for ironing or steam spraying depending on the operational mode of the system iron.

Technical Solution

The system iron according to the present disclosure includes a body including a steam generator for generating steam; an ironing plate rotatably disposed on the body and spraying the steam, which is generated by the steam generator, to an outside thereof, a top being hung on an outer side of the ironing plate; a spreading unit for tensioning the top hung on the outer side of the ironing plate; a front press for holding a front surface of the top, which is hung on the outer side of the ironing plate; and a pair of arm tensioners for tensioning sleeves of the top hung on the outer side of the ironing plate, whereby it is possible to perform ironing using an iron or steaming using steam by changing the position of the ironing plate and to easily hold the front surface of the top by means of the front press.

The system iron according to the present disclosure includes a body including therein a steam generator for generating steam; an ironing plate, which is rotatably coupled to an upper portion of the body and which includes therein steam nozzles for spraying the steam generated by the steam generator to an outside; a first fan for discharging air to the outside of the ironing plate or sucking air into the ironing plate; and a second fan for cooling an iron placed on the ironing plate, whereby it is possible to hold a garment on the ironing plate or to cool the iron.

The ironing plate includes a clothing-ironing board including therein the first fan and the steam nozzles; and an iron rest including therein the second fan, which discharges air to the clothing-ironing board in order to cool an iron placed on the iron rest, and the iron rest includes an iron-resting plate, which is disposed on the upper surface of the iron rest and has therein a plurality of suction holes through which air flows, the iron-resting plate being provided thereon with a silicone insulation material, whereby it is possible to provide a space in which the iron in use is placed or cooled.

The system iron according to the present disclosure includes a body including therein a steam generator for generating steam; an ironing plate, which is rotatably coupled to an upper portion of the body and which is changed in position depending on whether the system iron is operated in an ironing mode or in a steam-spraying mode in which steam is sprayed to a top, the ironing plate including a spreading unit for tensioning the top hung on the outer side thereof in the steam-spraying mode and a holding unit for holding the front surface of the top hung on the outer side thereof; a first fan for discharging air to the outside of the ironing plate or sucking air into the ironing plate; and a second fan for cooling an iron placed on the ironing plate, whereby it is possible to operate the fans in consideration of the ironing mode.

Advantageous Effects

First, since the system iron according to the present disclosure is able to perform both ironing using an iron and garment steaming by means of a single apparatus, there is an advantage in that it is possible to use a single apparatus to perform various ironing operations as required by a user.

Second, the system iron according to the present disclosure offers advantages in that it is possible to easily perform ironing by causing a garment, placed on the ironing plate, to be held on the ironing plate or to be spaced apart from the ironing plate by means of the first fan and it that it is possible to prevent safety accident by rapidly cooling a iron after use thereof by means of the second fan.

Third, since the system iron according to the present disclosure is provided with the silicone insulation material disposed on the iron-resting plate so as to provide a space in which an iron in use is placed, there is an advantage of providing convenience to a user.

Fourth, since the system iron according to the present disclosure enables the first fan and the second fan to be differently operated depending on the operational mode, there is an advantage of improving the quality of ironing.

DESCRIPTION OF DRAWINGS

FIGS. 5A AND 5B are views illustrating a height adjustment unit of the system iron according to an embodiment of the present disclosure, in which FIG. 5A illustrates the state in which an ironing plate is locked and FIG. 5B illustrates the state in which the ironing plate is movable;

DETAILED DESCRIPTION

Figure 1:
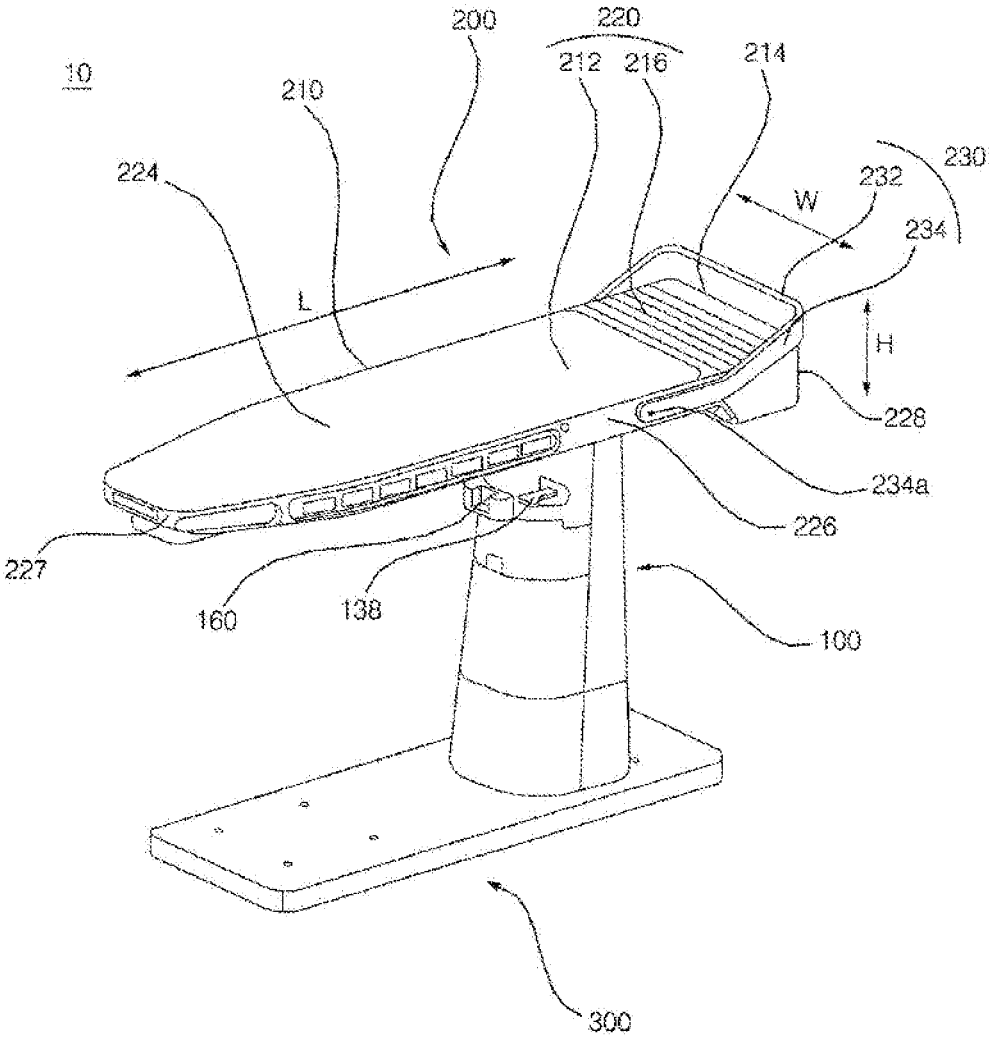
FIG. 1 is a perspective view of a system iron according to an embodiment of the present disclosure in an ironing mode.

Hereinafter, the present disclosure will be described with reference to the drawings, which are provided to illustrate a system iron according to embodiments of the present disclosure.

The system iron 10 according to an embodiment of the present disclosure includes a body 100 including a steam generator for generating steam; an ironing plate 200 rotatably disposed on the body, on an outer side of which a top is hung and which sprays the steam generated by the steam generator; a spreading unit for tensioning the top hung on the outer side of the ironing plate; a front press 260 for holding the front surface of the top hung on the outer side of the ironing plate; and a pair of arm tensioners 270 for tensioning the sleeves of the top hung on the outer side of the ironing plate.

The system iron 10 according to the embodiment includes a body 100 including therein a steam generator for generating steam; an ironing plate 200 rotatably disposed on the body so as to be changed in position depending on whether the system iron is operated in an ironing mode, in which an ironing operation is performed or in a steam-spraying mode, in which the steam is sprayed to a top; a spreading unit for tensioning the top hung on the outer side of the ironing plate in the steam-spraying mode; a front press 260 for holding the front surface of the top hung on the outer side of the ironing plate in the steam-spraying mode; and a pair of arm tensioners 270 for tensioning the sleeves of the top hung on the outer side of the ironing plate in the steam-spraying mode.

Figure 2:
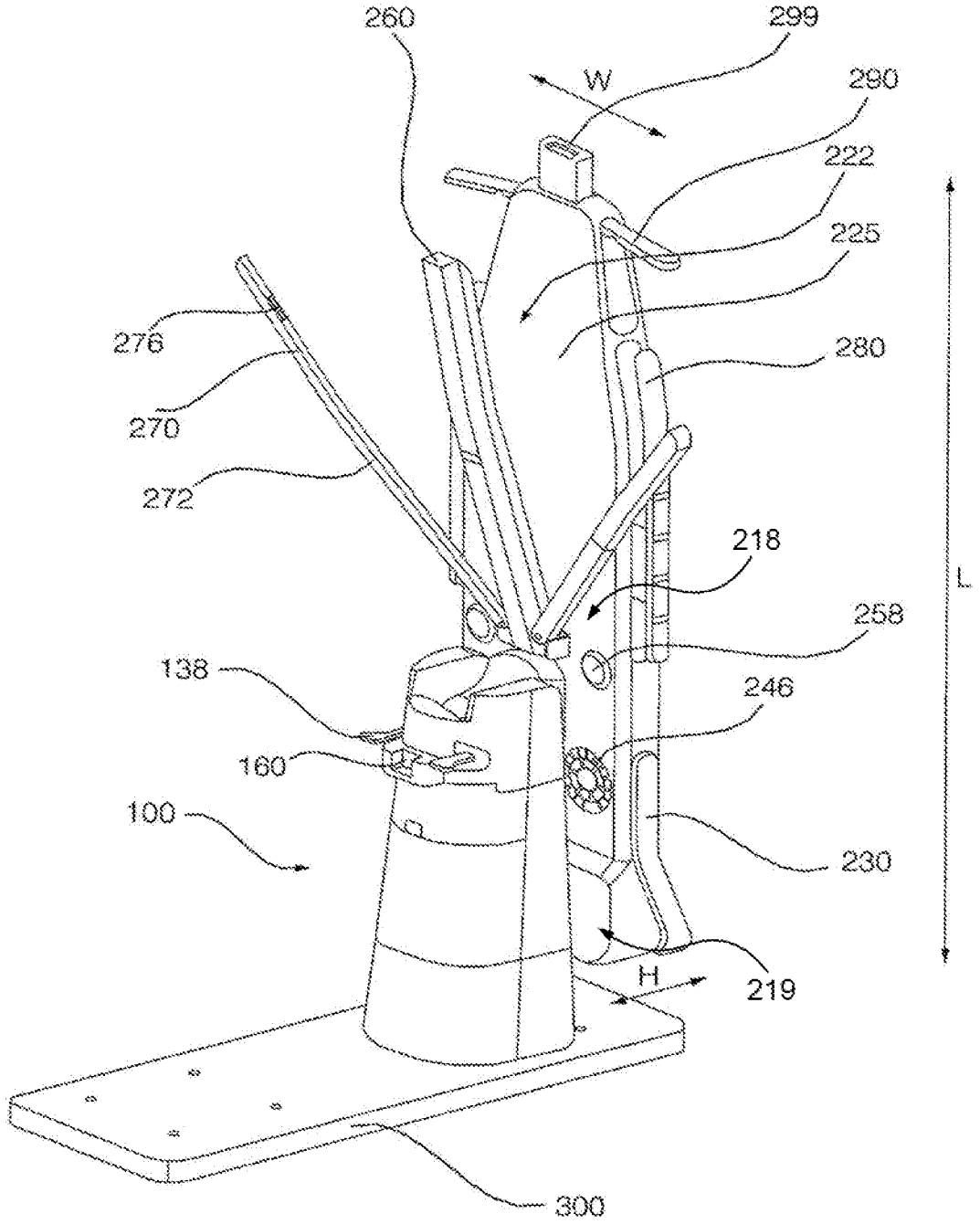
FIG. 2 is a perspective view of the system iron according to an embodiment of the present disclosure in a steam-spraying mode.
Figure 3:
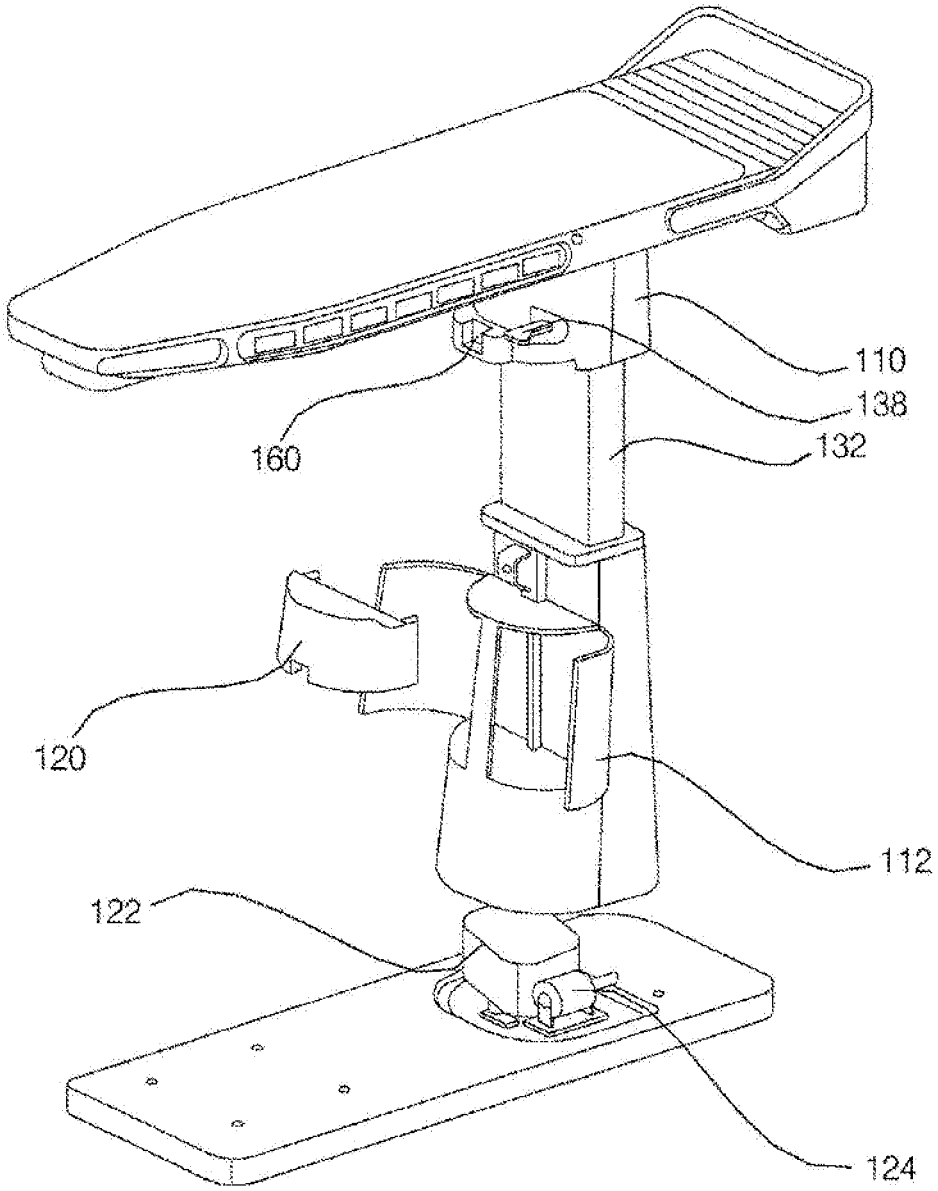
FIG. 3 is an exploded view of the body of the system iron according to an embodiment of the present disclosure.
Figure 4:
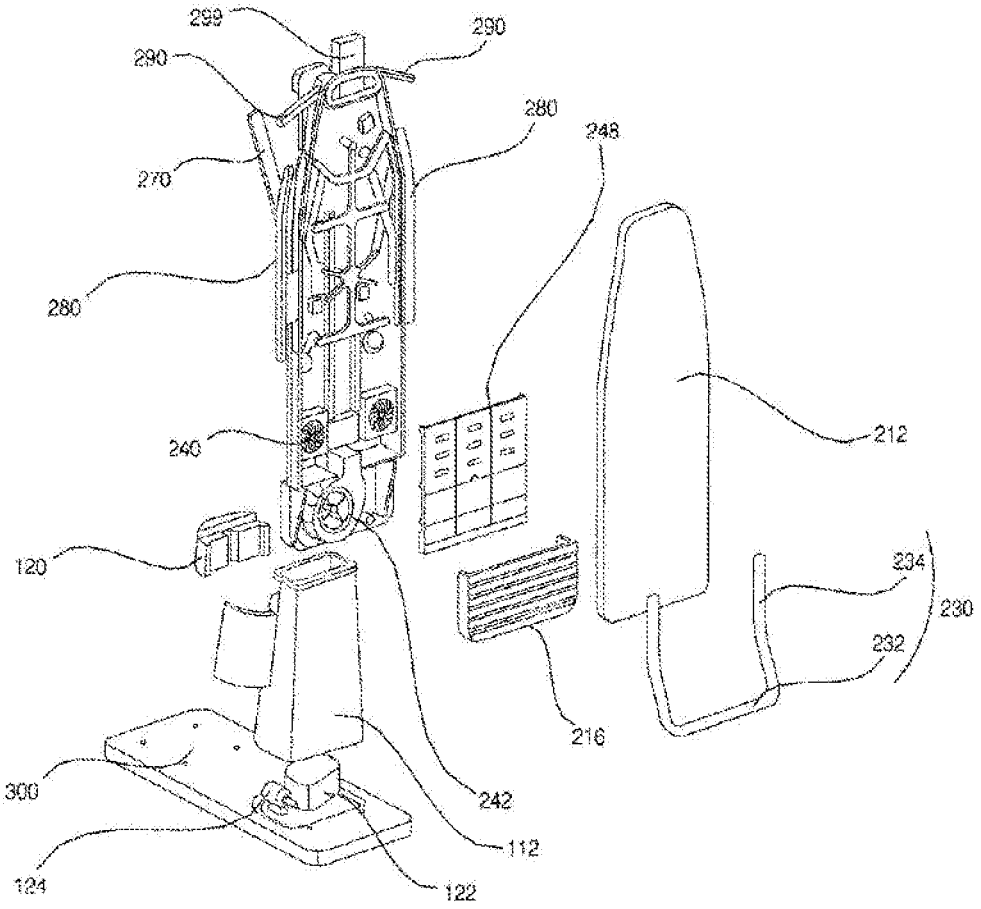
FIG. 4 is an exploded view of the system iron according to an embodiment of the present disclosure.
Figure 5A:
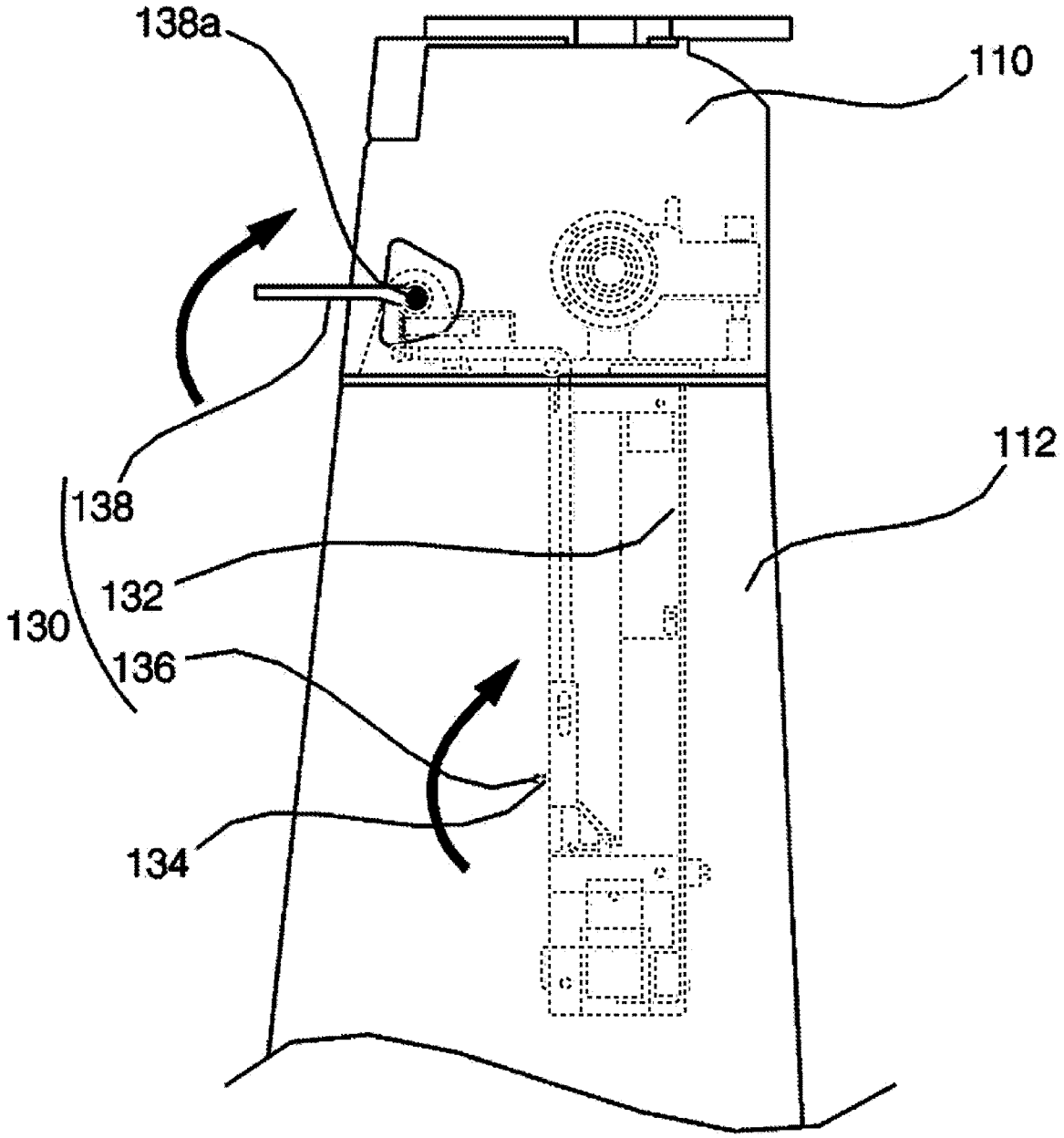
Figure 5B:
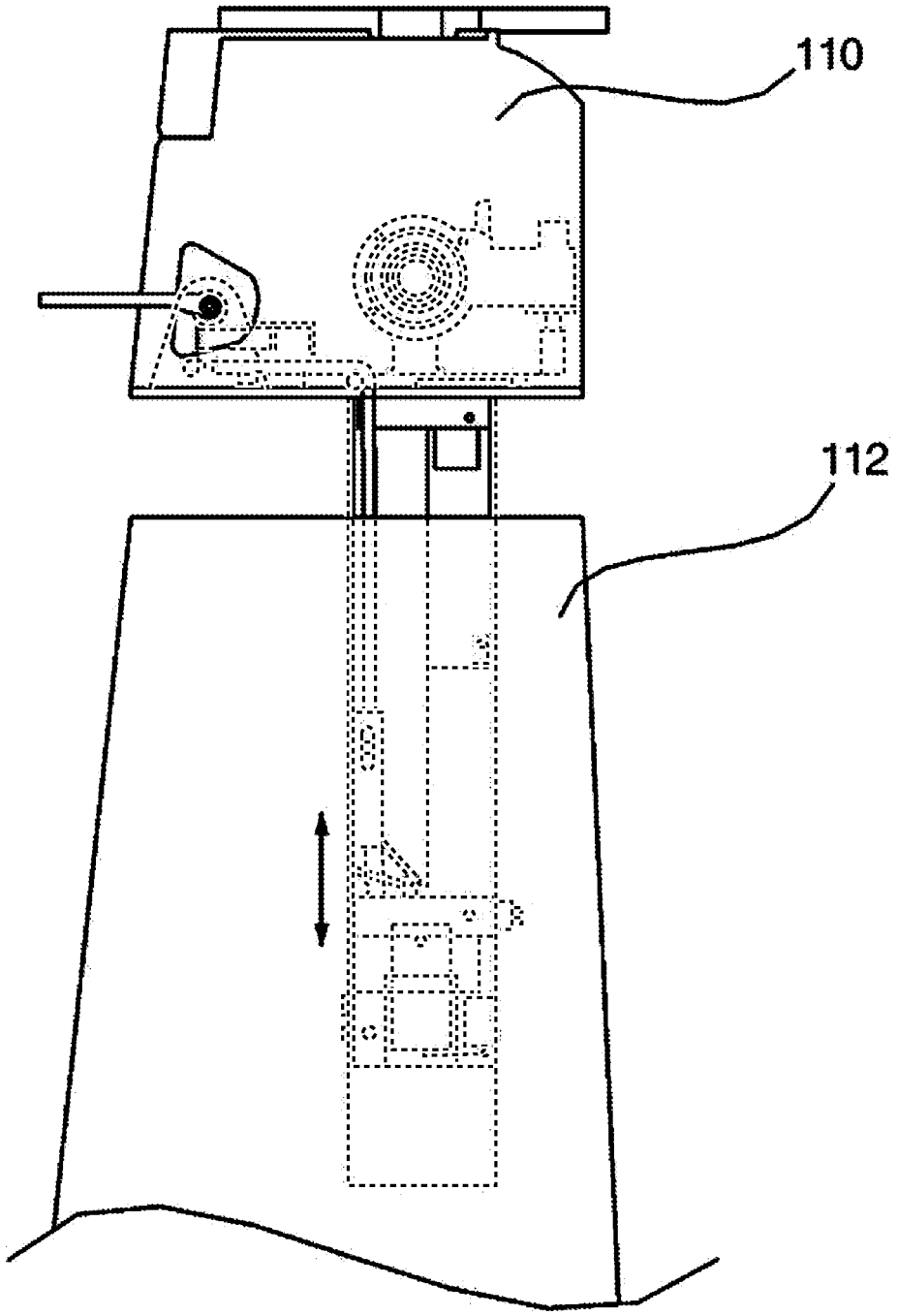

FIG. 1 is a perspective view of the system iron according to an embodiment of the present disclosure in an ironing mode. FIG. 2 is a perspective view of the system iron according to an embodiment of the present disclosure in a steam-spraying mode. FIG. 3 is an exploded view of the body of the system iron according to an embodiment of the present disclosure. FIG. 4 is an exploded view of the system iron according to an embodiment of the present disclosure. FIGS. 5A and 5B are views illustrating a height adjustment unit of the system iron according to an embodiment of the present disclosure.

The body of the system iron according to the embodiment will first be described with reference to FIGS. 1 to 5B.

The body 100 supports the ironing plate 200, which is connected to the upper side thereof. The body 100 according to the embodiment may be disposed so as to be perpendicular to the ground surface.

The body 100 is configured to have a cylindrical shape, the sectional area of which is decreased moving upwards.

The body 100 includes an upper body 110, to which a rotational member 250 is rotatably connected, and a lower body 112 for accommodating therein a water tank 120 and the steam generator. The upper body 110 and the lower body 112 are disposed such that the lower surface of the upper body 110 is in contact with the upper surface of the lower body 112. The lower surface of the upper body 110 and the upper surface of the lower body 112 may be disposed so as to be spaced apart from each other by means of the height adjustment unit 130.

The rotational member 250 of the ironing plate 200 is rotatably coupled to the upper side of the upper body 110. The upper body 110 is provided at the upper side thereof with two locking bars 142 for supporting the rotation of a hinge shaft disposed in the rotational member 250. The locking bars 142 are provided therein with circular cavities, in which the hinge shaft 252 is disposed.

The body 100 includes the water tank 120, the steam generator 122 for producing steam from the water stored in the water tank 120, and a vibration pump 124 for supplying the water from the water tank 120 to the steam generator 122. The lower body 112 includes the water tank 120, the steam generator and the vibration pump 124.

The water tank 120 is the space for storing water for generating steam. The water tank 120 is constructed so as to be releasably attached to the body 100. The water tank 120 may be filled with water when separated from the system iron and may then be fitted into the body 100.

The steam generator 122 is a device for generating steam from the water stored in the water tank 120. Some of the water stored in the water tank 120 is introduced into the steam generator 122 by virtue of vibration of the vibration pump 124.

The body 100 according to the embodiment includes therein a steam flow channel 244, which allows steam, generated by the steam generator, to flow to steam nozzles 245 in the ironing plate 200. The steam flow channel 244 according to the embodiment is positioned in the body 100 and the ironing plate 200.

The steam flow channel 244, which is positioned in the system iron according to the embodiment, may be divided into a body steam flow channel, which is positioned in the body, and an ironing plate steam flow channel, which is positioned in the ironing plate. The body steam flow channel and the ironing plate steam flow channel are connected to each other. Steam, which is generated by the steam generator, flows through the body steam flow channel and the ironing plate steam flow channel, and is then discharged from the steam nozzles 245. The steam nozzles 245 are disposed inside the spreading unit of the ironing plate 200. When the spreading unit is spread out to the outside of the ironing plate, the steam nozzles 245 spray steam to the outside.

The body 100 includes the height adjustment unit 130 for adjusting the height of the ironing plate 200. The height adjustment unit 130 adjusts the height of the ironing plate 200 by raising or lowering the upper body 110.

The height adjustment unit 130 includes a height adjustment box 132, which is retracted into the body 100 or is extended to the outside of the body 100 so as to adjust the height of the ironing plate 200, a locking unit 136 for restricting the movement of the height adjustment box 132 and a height adjustment lever 138, which is operated in linkage with the locking unit 136 so as to allow the height adjustment box 132 to be moved.

The height adjustment box 132 according to the embodiment is configured to have a cuboid box shape. The height adjustment box 132 is disposed under the upper body 110. The height adjustment box 132 is retracted into the lower body 112, or is extended upwards from the lower body 112. The height adjustment box 132 is moved upwards and downwards between the outside and the inside of the lower body 112. When the height adjustment box 132 is moved upwards and downwards, the upper body 110 and the ironing plate 200, which are disposed above the height adjustment box 132, are also moved upwards and downwards together with the height adjustment box 132.

The height adjustment box 132 is provided therein with the locking unit 136 for restricting the upward and downward movement of the height adjustment box 132. The height adjustment box 132 is provided in a side surface thereof with a projection hole 134 such that a part of the locking unit 136 projects outwards from the height adjustment box 132 through the projection hole 134.

The locking unit 136 serves to restrict the movement of the height adjustment box 132. The locking unit 136 may be disposed in the height adjustment box 132, and a part of the locking unit 136 may project through the projection hole 134 in the height adjustment box 132. When a projection member of the locking unit 136 projects outwards from the height adjustment box 132, the projection member is engaged with one side of the accommodation space in the height adjustment box 132 at a low position of the body 100, thereby restricting the movement of the height adjustment box 132.

When the part of the locking unit 136 projects outwards through the projection hole 134 in the height adjustment box 132, the height adjustment unit 130 is maintained in the locked state, thereby restricting the upward and downward movement of the height adjustment box 132. When the projection member of the locking unit 136 does not project outwards through the projection hole 134 in the height adjustment box 132, the height adjustment unit 130 is released from the locked state, thereby allowing upward and downward movement of the height adjustment box 132.

The locking unit 136 is operated in linkage with the height adjustment lever 138. A user may switch the height adjustment unit 130 between the locked state and the released state using the height adjustment lever 138. A user may cause the projection member of the locking unit to project outwards from the height adjustment box 132 or to be retracted into the height adjustment box 132 using the height adjustment lever 138. A user may move the height adjustment box 132 using the height adjustment lever 138.

The height adjustment lever 138 is disposed at the upper body 110. The height adjustment lever 138 may be connected to the locking unit 136. The height adjustment lever 138 may cause the projection member of the locking unit 136 to project to the outside of the height adjustment box 132 or to be disposed in the height adjustment box 132 using a wire.

The height adjustment unit 130 according to the embodiment is constructed such that, when the height adjustment lever 138 is rotated upwards about a lever shaft 138*a* as shown in FIG. 5A, the locking unit 136 is released, thereby allowing the height adjustment box 132 to be moved upwards and downwards as shown in FIG. 5B.

The body according to the embodiment includes the support-leg mount 160, on which a support leg 266 (see FIG. 11) of a support unit of the ironing plate 200, which will be described later, is mounted. The support-leg mount 160 is the portion formed at the upper body 110, on which one end of the support leg 266 is mounted.

Figure 6:
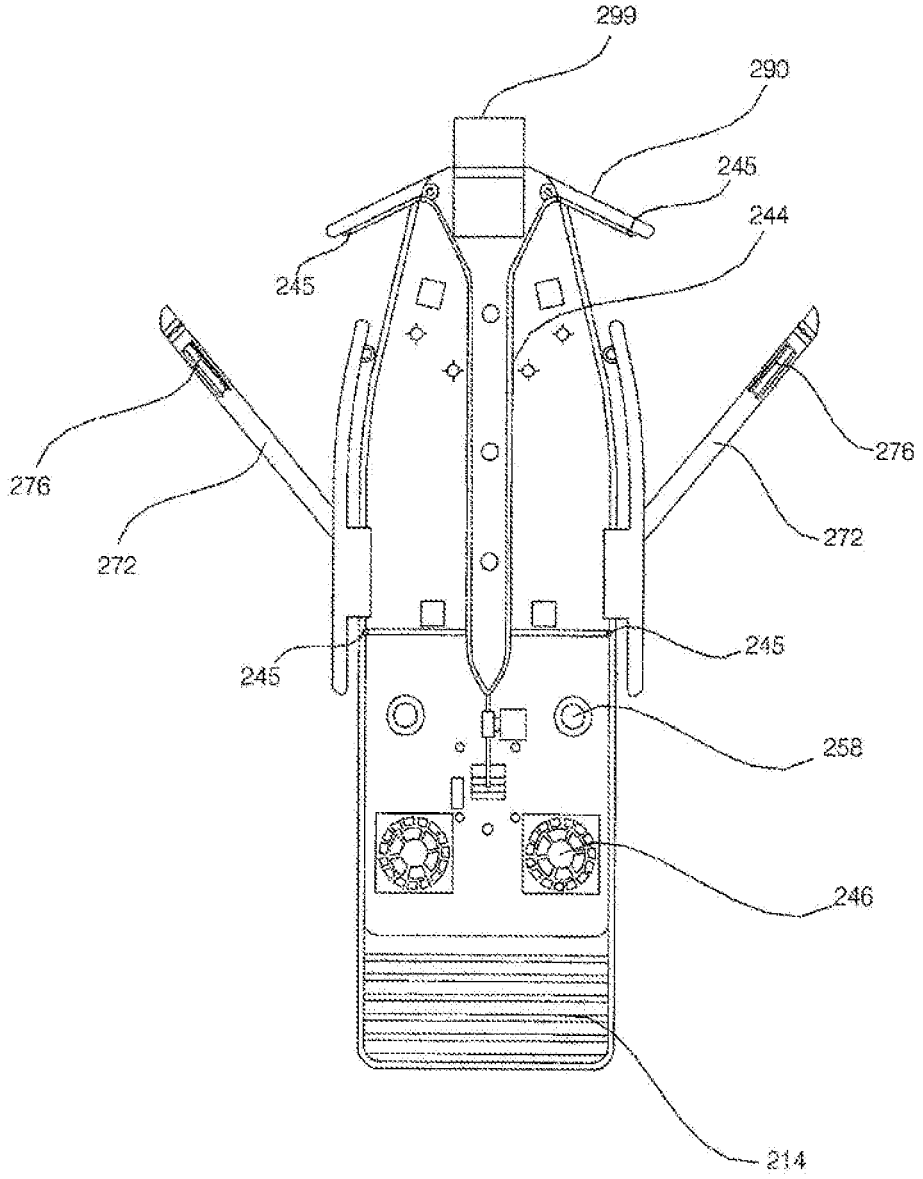
FIG. 6 is a view showing a planar surface of the ironing plate from which a clothing-ironing plate and a first fan have been removed in order to show the steam flow channel and the steam nozzles of the system iron according to an embodiment of the present disclosure.
Figure 7:
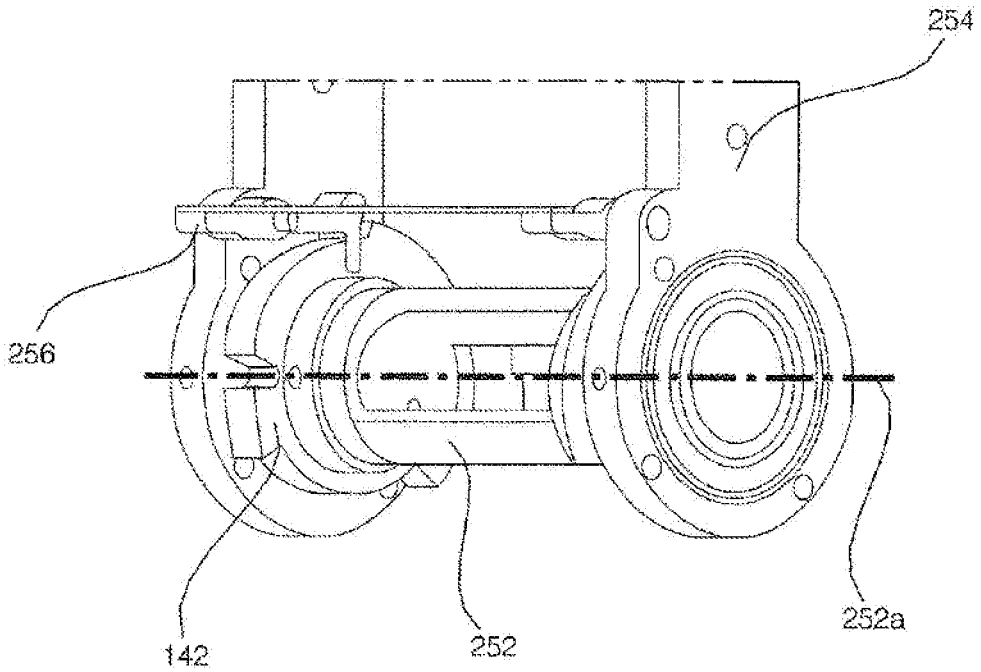
FIG. 7 is a view illustrating a hinge shaft and an angle-limiting unit in the rotational member, which are intended to rotate or lock the ironing plate of the system iron according to an embodiment of the present disclosure.

FIG. 6 is a view showing the planar surface of the ironing plate from which a clothing-ironing plate and a first fan are removed in order to show the steam flow channel and the steam nozzles of the system iron according to an embodiment of the present disclosure. FIG. 7 is a view illustrating a hinge shaft and an angle-limiting unit in the rotational member, which are intended to rotate or lock the ironing plate of the system iron according to an embodiment of the present disclosure.

Hereinafter, the ironing plate of the system iron will be described with reference to FIGS. 1 to 4, FIG. 6 and FIG. 7.

The ironing plate 200 according to the embodiment is a plate functioning to iron clothing or to spray steam on clothing hung on the outer side of the ironing plate 200. The ironing plate 200 is rotatably connected to the upper side of the body 100.

The ironing plate 200 according to the embodiment is changed in position depending on the mode in which the ironing plate 200 is used. As shown in FIG. 1, the system iron 10 according to the embodiment may be operated in the ironing mode in which clothing is ironed using an iron, as shown in FIG. 1, or in the steam-spraying mode, in which a top is hung on the outer side of the ironing plate 200 and steam is sprayed to the top hung on the ironing plate 200, as shown in FIG. 2.

The ironing plate 200 according to the embodiment is disposed parallel to the ground surface in the ironing mode and is disposed perpendicular to the ground surface in the steam-spraying mode. The ironing plate 200 according to the embodiment is disposed perpendicular to the body 100 in the ironing mode and is disposed parallel to the body 100 in the steam-spraying mode.

The ironing plate 200 according to the embodiment is rotated about a rotational axis 252*a* (see FIG. 7), which is provided at the upper portion of the upper body 110. The ironing plate 200 is rotated about the rotational axis 252*a*, which is provided at the locking bars 142 of the upper body 110, so as to be changed in position depending on whether the system iron is operated in the ironing mode or in the steam-spraying mode. The ironing plate 200 according to the embodiment is constructed so as to be rotated within a range of 0 to 90 degrees when the operational mode is changed between the ironing mode and the steam-spraying mode. However, this is merely one example, and the ironing plate 200 may be set to be rotated within an angular range of 0 to greater than 90 degrees.

In the description of the ironing plate 200 according to the embodiment, on the basis of FIG. 1, the surface of the ironing plate 200 that is connected to the body 100 is referred to as a lower surface 225, the surface of the ironing plate 200 that is opposite the lower surface 225 and on which clothing is ironed in the ironing mode is referred to as an upper surface 224, the surfaces of the ironing plate 200, on which side tensioners 280 and shoulder tensioners 290 are disposed, among the surfaces connecting the upper surface 224 and the lower surface 225, are referred to as side surfaces 226, the surface of the ironing plate 200, on which a neck clip 299 is disposed and which is adjacent to portions at which the shoulder tensioners 290 are disposed, among the surfaces connecting the upper surface 224 and the lower surface 225, is referred to as a front surface 227, and the surface of the ironing plate 200 that is opposite the front surface 227, among the surfaces connecting the upper surface 224 and the lower surface 225, is referred to as a rear surface 228.

In addition, on the basis of FIG. 1, a linear direction in which the neck clip is connected to an iron rest is referred to as a longitudinal direction L, a linear direction in which the side tensioners 280, which are disposed at the two side surfaces 226 of the ironing plate 200, are connected to each other is referred to as a width direction W, and a linear direction in which the upper surface 220 and the lower surface 225 of the ironing plate 200 are connected to each other is referred to as a height direction H. In the longitudinal direction L, the direction toward the front surface 227 is referred to as a forward direction, and the direction opposite the forward direction and toward the lower surface 225 is referred to as a rearward direction. In the height direction H, the direction that the upper surface 224 of the ironing plate 200 faces is referred to as an upward direction, and the direction that the lower surface 225 faces is referred to as a downward direction. The longitudinal direction L, the width direction W and the height direction H define relationships such that they are perpendicular to one another. These definitions may be used in the description of the ironing plate 200, and may be similarly used whether the operation mode is changed to the ironing mode as shown in FIG. 1 or to the steam-spraying mode as shown in FIG. 2. These definitions of direction are merely for illustration of the present disclosure and do not restrict the scope of the present disclosure.

The ironing plate 200 according to the embodiment includes an ironing-plate case 222, which defines the appearance of the ironing plate 200 and which is open at the upper plane 224, and an upper plate 220 disposed on the upper plane of the ironing plate 200. The ironing-plate case 222 and the upper plate 220 define the appearance of the ironing plate 200. The ironing-plate case 222 defines the lower surface 225, the side surfaces 226, the front surface 227 and the rear surface 228 of the ironing plate 200. The ironing-plate case 222 is coupled at the lower surface 225 to the body 100.

The upper plate 220 includes a clothing-ironing plate 212 disposed on a clothing-ironing board 210, which will be described later, and an iron-resting plate 216 disposed on an iron rest 214. The ironing-plate case 222 includes a clothing-ironing-board case 218 defining the lower surface and the lateral side surfaces of the clothing-ironing board 210, and an iron-rest case 219 defining the lower surface of the lateral side surfaces of the iron rest 214.

The ironing plate 200 according to the embodiment includes the clothing-ironing board 210, which is used to iron clothing in the ironing mode or on which clothing is hung in the steam-spraying mode, and the iron rest 214 on which the iron is placed in the ironing mode. The clothing-ironing board 210 is disposed at the front part of the ironing plate 200 in the longitudinal direction L, and the iron rest 214 is disposed at the rear part of the ironing plate 200 in the longitudinal direction L.

The clothing-ironing board 210 is a part on which clothing is hung so as to be ironed using an iron in the ironing mode. The clothing-ironing board 210 is a part on which clothing is hung in the steam-spraying mode. The clothing-ironing board 210 is configured so as to have a shape similar to a typical ironing plate 200 having a surface area which is reduced moving forwards in the longitudinal direction L of the ironing plate 200. The clothing-ironing board 210 includes the clothing-ironing-board case 218, which defines the appearance of the clothing-ironing board and is open at the upper surface thereof, and the clothing-ironing plate 212, in which a through hole is formed so as to allow the air inside the ironing plate 200 and the air outside the ironing plate 200 to communicate with each other. The clothing-ironing-board case 218 is rotatably coupled at the lower surface thereof to the body 100. The clothing-ironing-board case 218 is provided on the lower surface thereof with the front press 260, and is provided on the lateral side surfaces thereof with the side tensioners 280 and the shoulder tensioners 290. The clothing-ironing-board case 218 is provided with an opening hole through which air under a first fan 240 flows due to the operation of the first fan 240.

The clothing-ironing board 210 is provided therein with the first fan 240, which is intended to suck air into the inside of the ironing plate 200 or to discharge air to the outside of the ironing plate 200 through the through hole formed in the clothing-ironing plate 212. The first fan 240 may be rotated in a forward direction or a reverse direction. The first fan 240 may be embodied by an axial fan.

The first fan 240 serves to suck air through the through hole in the clothing-ironing plate 212 in the ironing plate or serves to discharge air through the through hole in the clothing-ironing plate 212 in the steam-spraying mode. An opening hole 246 is formed in a lower portion of the ironing-plate case 222 so as to allow air to flow to the inside and outside of the ironing plate 200 by virtue of the first fan 240.

The clothing-ironing board 210 is provided therein with a guide plate 248 for guiding air, which flows by means of the first fan 240, toward the through hole.

The clothing-ironing board 210 includes the steam nozzles 245 for spraying steam, which is generated by the steam generator 122, toward the outside. The steam nozzles 245 receive steam, which is generated by the steam generator 122, through the steam flow channel 244. In the steam-spraying mode, steam, which is generated by the steam generator 122, is sprayed through the steam nozzles 245 disposed in the clothing-ironing board 210.

The iron rest 214 is a zone on which the iron, which is used in the ironing mode, is placed. The iron rest 214 includes the iron-rest case 219, which defines the appearance of the iron rest and is open at the upper surface thereof, and the iron-resting plate 216, which is disposed on the upper plane of the iron-rest case and is provided therein with a plurality of suction holes through which air flows. The iron rest 214 is provided therein with a second fan 242 so as to suck air through the plurality of holes formed in the iron-resting plate 216. The second fan 242 is preferably embodied by a sirocco fan, which causes the direction of air suction to be perpendicular to the direction of air discharge. When the second fan 242 is activated, air is sucked into the iron-resting plate 216 and is then discharged to the inside of the clothing-ironing board 210.

A silicone insulation material is disposed on the iron-resting plate 216. Accordingly, even when a high temperature iron, which is in use, is placed on the iron rest 214, it is possible to prevent a fire and contamination of the heating plate of the iron by virtue of provision of the silicone insulation material. In addition, it is possible to rapidly cool the iron, upon termination of use thereof, by activating the second fan 242 in the iron rest 214.

The ironing plate 200 may further include an iron protector 230 for preventing the iron, which is placed on the iron rest, from falling out of the iron rest. The iron protector 230 is configured so as to have a 'U' shape. The two ends of the iron protector 230 are rotatably disposed at the two side surfaces 226 of the ironing plate 200.

The iron protector includes a horizontal bar 232, which is positioned outside the iron rest so as to prevent the iron from escaping from the iron rest, and a pair of vertical bars 234, which are bent from the two ends of the horizontal bar 232 in a direction perpendicular thereto and which allow the horizontal bar 232 to be moved.

The pair of vertical bars 234 are connected at first ends thereof to the two ends of the horizontal bar 232, and are rotatably connected at the second ends thereof to the two side surfaces 226 of the ironing plate 200. The vertical bars 234 are rotated about rotational shafts 234*a* formed on the two side surfaces 226 of the ironing plate 200. As the vertical bars 234 are rotated, the position of the horizontal bar 232 is changed. Referring to FIG. 1, the horizontal bar 232 is positioned outside the iron rest in the ironing mode, thereby preventing the iron from escaping to the outside of the iron rest.

The iron protector 230 may hold a rear portion of a top, which is hung on the ironing plate 200, in the steam-spraying mode. The iron protector 230 holds a rear surface of a top, which is hung on the outer side of the ironing plate 200. The horizontal bar 232 is held on the clothing-ironing plate 212 in the steam-spraying mode, thereby holding a rear surface 228 of a top, which is hung on the ironing plate 200. The horizontal bar 232 may include a magnetic material. In the steam-spraying mode, the horizontal bar 232 is detachably attached to the clothing-ironing board 210 by virtue of the magnetic material.

The ironing plate 200 includes the rotational member 250, which is rotatably coupled to the body 100, a holding unit for holding a top, hung on the ironing plate 200, in the steam-spraying mode, and the spreading unit for tensioning the top hung on the ironing plate 200 in the steam-spraying mode. The clothing-ironing board 210 includes the rotational member 250, the holding unit and the spreading unit.

The rotational member 250 projects from the lower surface 225 of the ironing-plate case 222. The rotational member 250 is disposed at the upper portion of the body 100. The rotational member 250 is configured to have a shape complementary to the upper portion of the body 100 such that the rotational member 250 is rotatable at the upper portion of the body 100.

Referring to FIG. 7, the rotational member 250 is rotated about the rotational axis 252*a*, which is formed between the body 100 and the rotational member. The rotational member 250 includes a hinge shaft 252, which is rotated about the rotational axis 252*a*, and connecting bars 254 connecting the hinge shaft 252 to the ironing plate 200. The rotational member 250 further includes an angle-limiting unit 256 for limiting rotation of the hinge shaft 252 and a button unit 258, which is operated in linkage with the angle-limiting unit 256 so as to allow rotation of the hinge shaft 252.

The hinge shaft 252 is disposed in the cavities in the two locking bars 142. The hinge shaft 252 is rotated in the cavities in the locking bars 142. The connecting bars 254 are disposed at the two ends of the hinge shaft 252. The connecting bars 254 transmit the rotating force of the hinge shaft 252 to the ironing plate 200. When the hinge shaft 252 is rotated, the connecting bars 254 are rotated about the rotational axis 252*a*, thereby rotating the ironing plate 200. The connecting bars 254 are provided with the angle-limiting unit 256 for limiting rotation of the hinge shaft 252.

The angle-limiting unit 256 is rotated with the connecting bars 254. The locking bar 142 is provided with a plurality of locking grooves into which the angle-limiting unit 256 is inserted. A part of the angle-limiting unit 256 is inserted into one of the plurality of locking grooves formed in the locking bar 142, thereby locking the ironing plate 200. When the angle-limiting unit 256 is inserted into one of the plurality of locking grooves in the locking bar 142, rotation of the hinge shaft 252 is limited.

The angle-limiting unit 256 is operated in linkage with the button unit 258. Referring to FIGS. 2 and 8, in the ironing plate 200 according to the embodiment, when the button unit 258 is pushed, the angle-limiting unit 256 is separated from the groove in the locking bar 142. When the button unit 258 is pushed by a user, the hinge shaft 252 is allowed to be moved.

The holding unit is a member for holding a top hung on the ironing plate 200 in the steam-spraying mode. The holding unit includes a magnetic material. The holding unit is detachably attached to the ironing plate 200 by virtue of the magnetic material. The holding unit includes a front press 260 for holding the front surface 227 of a top and the iron protector 230 for holding the rear surface 228 of the top.

The front press 260 serves to hold a top hung on the ironing plate 200 in the steam-spraying mode. The front press 260 is disposed under the lower surface 225 of the ironing plate 200 and extends in the longitudinal direction L of the ironing plate 200. The front press 260 brings the front surface of the top, hung on the ironing plate 200, into close contact with the lower surface 225 of the ironing plate 200 in the steam-spraying mode. The front press 260 brings the front surface of the top, hung on the outer side of the ironing plate 200, into close contact with the lower surface 225 of the ironing plate 200. The front press 260 is detachably attached to the lower surface 225 of the ironing plate 200 by virtue of the magnetic material. The detachable attachment of the front press using the magnetic material is merely one example, and another member, which functions to hold the front surface of the top between the lower surface of the ironing plate 200 and the front press 260, may also be used.

The magnetic force, which is created between the front press 260 and the ironing plate 200 so as to hold the front surface of the top hung on the outer side of the ironing plate, is set to be greater than the force exerted by the side tensioners 280 so as to spread the side surfaces of the top.

The front press 260 is disposed under the lower surface 225 of the ironing-plate case 222. The front press is hingedly coupled to the ironing plate 200 so as to be detachably attached to the lower surface of the ironing plate 200. The front press 260 is rotated about a press-plate hinge 264, which is provided at one side of the front press 260. The press-plate hinge 264 is disposed on the lower surface 225 of the ironing-plate case 222 so as to be positioned in front of and adjacent to the rotational member 250 in the longitudinal direction L of the ironing plate 200.

The front press 260 includes a press plate 262, which comes into contact with the ironing-plate case 222, and the press-plate hinge 264, which serves to hingedly couple the press plate 262 to the ironing plate 200. The press plate 262 comes into contact with the lower surface 225 of the ironing-plate case 222. The front press 260 is disposed adjacent to the rotational member 250 and extends in the longitudinal direction L of the ironing plate 200. The press-plate hinge 264 is disposed at the end of the front press 260 adjacent to the rotational member 250. The press-plate hinge 264 includes a rotational shaft 264*a*, which extends parallel to the width direction W of the ironing plate 200 so as to allow the press plate 262 to be rotated thereabout.

A top, which is hung on the ironing plate 200, is disposed between the press plate 262 and the ironing-plate case 222. The top, which is hung on the ironing plate 200, is held between the press plate 262 and the ironing-plate case 222.

Figures 8A, 8B:
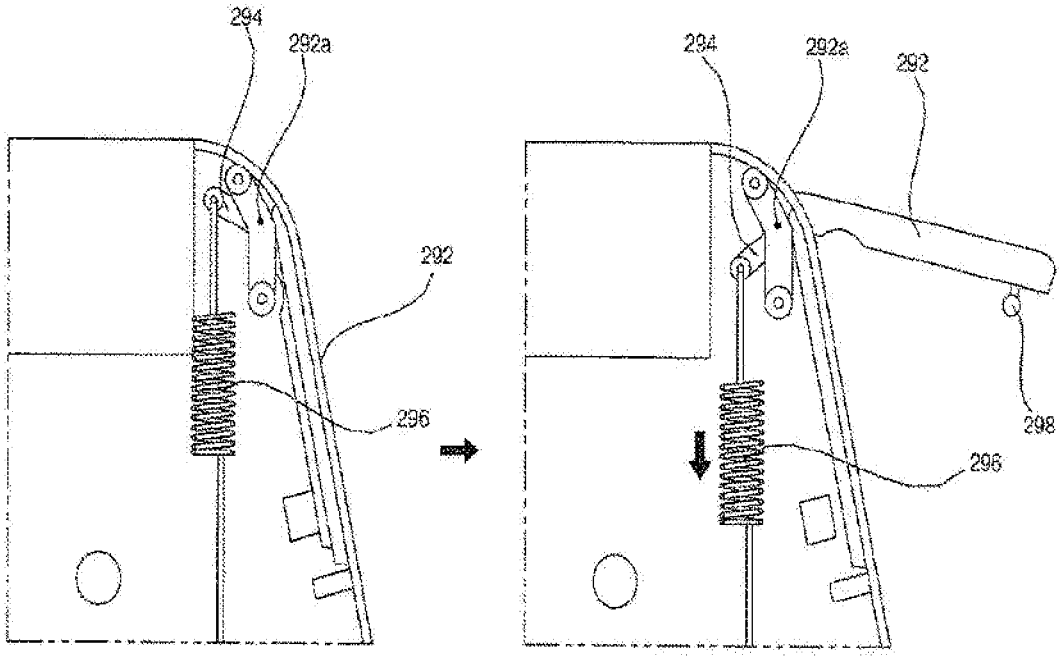
FIGS. 8A and 8B are views illustrating shoulder tensioners of the system iron according to an embodiment of the present disclosure.
Figures 9A, 9B:
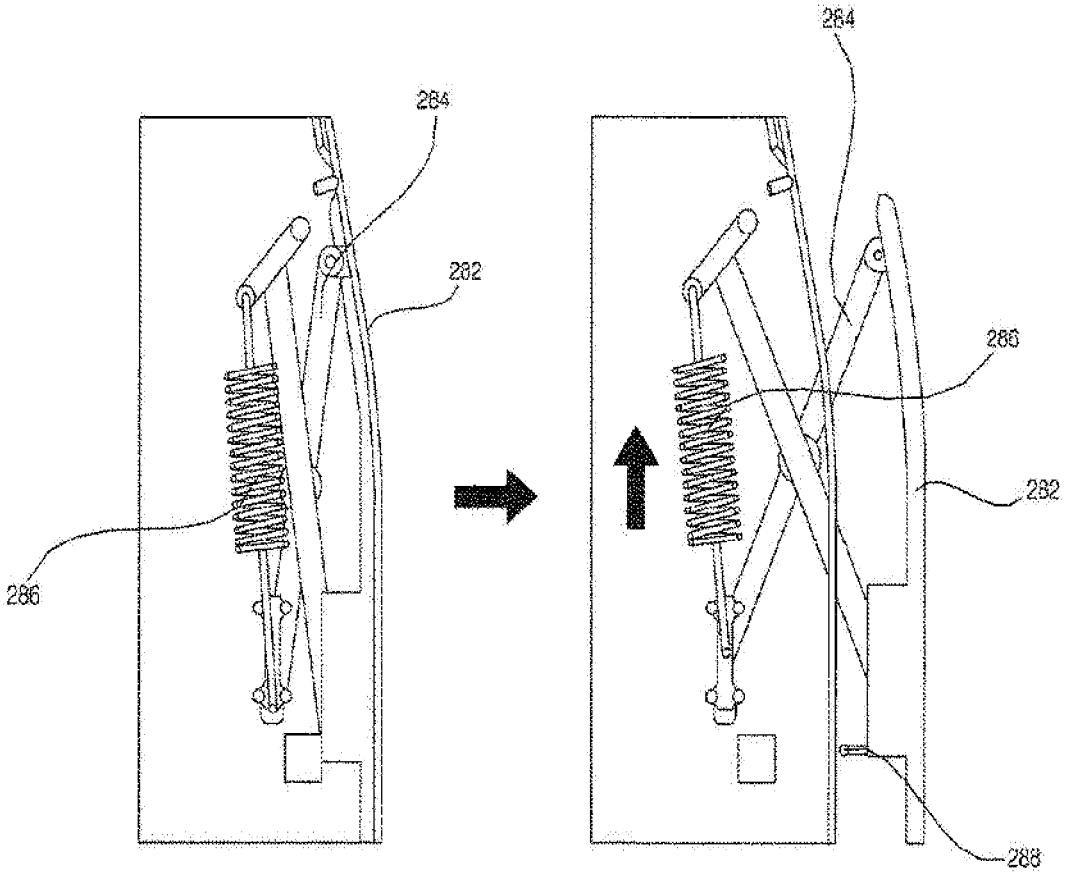
FIGS. 9A and 9B are views illustrating side tensioners of the system iron according to an embodiment of the present disclosure.

FIGS. 8A and 8B are views illustrating the shoulder tensioners of the system iron according to an embodiment of the present disclosure. FIGS. 9A and 9B are views illustrating the side tensioners of the system iron according to an embodiment of the present disclosure. Hereinafter, the side tensioners and the shoulder tensioners, which constitute the spreading unit, will be described with reference to FIGS. 8A and 8B and FIGS. 9A and 9B.

The spreading unit tensions a top, which is hung on the ironing plate 200, in order to eliminate wrinkles in the top. The spreading unit includes the side tensioners 280 for tensioning the right and left sides of the top and the shoulder tensioners 290 for holding shoulder portions of the top and for tensioning the same.

The side tensioners 280 and the shoulder tensioners 290 are intended to tension the right and left sides of the top and the two shoulder portions of the top. The side tensioners 280 are composed of a pair of right and left tensioners, and the shoulder tensioners 290 are composed of a pair of right and left tensioners, which are symmetrical with each other.

Referring to FIGS. 9A and 9B, the pair of side tensioners 280 uniformly tension the right and left sides of the top hung on the ironing plate 200 in order to eliminate wrinkles in the top. The pair of side tensioners 280 are disposed at the two side surfaces 226 of the ironing plate 200. Each of the pair of side tensioners 280 includes a side bar 282, which comes into contact with the inner surface of the top, a support member 284 for linearly moving the side bar 282 outwards from the ironing plate 200 in the width direction W in a reciprocating manner, an elastic member 286 for exerting compressive force on the ends of the support member 284, and a one-touch click button 288 for holding the side bar 282 at the side surface 226.

The support member 284 according to the embodiment is configured to have an 'X' shape, and is vertically moved at first ends thereof by means of the elastic member, thereby moving the side bar 282 in the lateral direction of the ironing plate 200. The elastic member 286 according to the embodiment is embodied as a spring for exerting compressive force on the ends of the support member. The elastic member 286 may be replaced with any another member capable of exerting compressive force.

A user may release the locked state of the one-touch click button 288 by pushing the side bar 282. When the locked state of the one-touch click button 288 is released, the compressive force of the elastic member 286 is applied to the support member 284, and the side bar 282 is thus moved outwards from the side surface 226 of the ironing plate 200.

Referring to FIGS. 8A and 8B, the pair of shoulder tensioners 290 tension the two shoulder portions of the top. The shoulder tensioners 290 serve to enable the top to be stably hung on the ironing plate 200. The shoulder tensioners 290 are respectively rotated about hinge shafts 292*a*, which are formed at regions adjacent to the front surface 227 of the ironing plate 200. The pair of shoulder tensioners 290 are disposed at the two side surfaces 226 of the ironing plate 200 so as to be positioned at the front side in the longitudinal direction L of the ironing plate 200. The pair of shoulder tensioners 290 are spread from the two side surfaces 226 of the ironing plate 200 forwards in the longitudinal direction L of the ironing plate 200.

Each of the pair of shoulder tensioners 290 includes a hanger 292 for supporting the shoulder portions of the top hung on the outer side of the ironing plate, an elastic member 296 for spreading the hanger 292 outwards and forwards from the ironing plate 200, and a one-touch click button 298 for locking the hanger 292 so as to be held at the side surface 226 and for releasing the locked state of the hanger 292.

The hanger 292 is disposed at the front side of the side surface 226 of the ironing plate 200. The elastic member 296 exerts compressive force on the end of the hanger 292. The elastic member may be embodied by a member such as a spring.

The hanger 292 includes a hanger projection, which is bent at one end of the hanger 292 and extends to the inside of the ironing plate 200. The hanger projection 294 is connected at one end thereof to the hanger 292, and is connected at the other end thereof to the elastic member 296. The hanger projection 294 is provided between the two ends thereof with a hinge shaft 292*a*, about which the hanger 292 is rotated.

When a user pushes the lower portion of the hanger 292, the locked state of the one-touch click button 298 is released. When the locked state of the one-touch click button 298 is released, the other end of the projection of the hanger 292 is pulled by means of the compressive force of the elastic member 296. Due to the rotation of the hanger projection 294, the hanger 292 is projected outwards from the side surface 226. When the locked state of the one-touch click button 298 is released, the hanger 292 tensions the shoulder portions of the top hung on the ironing plate 200.

Figure 10:
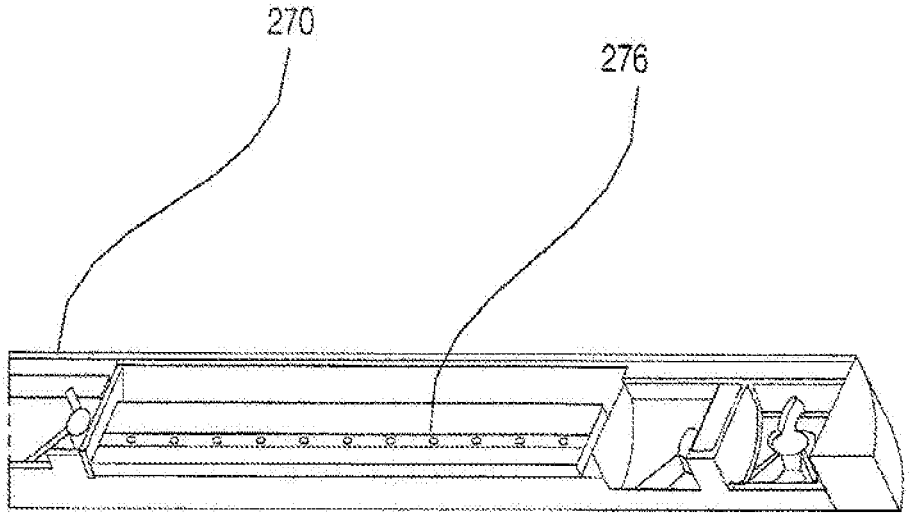
FIG. 10 is a view illustrating an arm tensioner including a sleeve-holding unit according to an embodiment of the present disclosure.

FIG. 10 is a view illustrating the arm tensioner including a sleeve-holding unit according to an embodiment of the present disclosure.

Hereinafter, the arm tensioners will be described. The pair of arm tensioners 270 serve to hold the two sleeve portions of the top hung on the ironing plate 200 and to tension the same in order to eliminate wrinkles in the two sleeve portions of the top. The arm tensioners 270 are also composed of a pair of tensioners, which are symmetrical to each other, so as to tension the two sleeves of the top. The arm tensioners 270 tension the sleeves of the top by pulling the sleeves of the top. The pair of arm tensioners 270 are disposed under the press plate 262 of the front press 260 in the height direction H of the ironing plate 200. When the press plate 262 is rotated about the press-plate hinge 264, the arm tensioners 270 are also rotated therewith. The arm tensioners 270 are rotated about the arm-tensioner hinges 274, thereby tensioning the sleeves of the top.

Each of the pair of arm tensioners 270 includes an arm-tension bar 272, which is hingedly coupled at one end thereof so as to be rotated on the lower surface of the ironing plate, and a sleeve-holding unit 276, which is disposed at the other end of the arm-tension bar so as to hold the sleeve of the top hung on the outer side of the ironing plate. The two rear ends of the pair of arm tensioners 270 are hingedly coupled to the lower surface of the front press 260, and the two front ends of the pair of arm tensioners 270 are rotated far away from each other.

The arm-tension bars 272 are rotated so as to tension the sleeves of the top. The arm tensioners 270 further include the arm-tensioner hinges 274, which allow the arm-tension bars 272 to be rotated.

The rotational shafts 274*a* of the arm-tensioner hinges 274 are configured so as to be perpendicular to the press plate 262. The rotational shafts 274*a* of the arm-tensioner hinges are configured so as to be perpendicular to the rotational shaft 264*a* of the press-plate hinge 264. Each of the arm-tension bars 272 is provided at one end thereof with the arm-tensioner hinge 274, and is provided at the other end thereof with the sleeve-holding unit 276. The pair of arm-tensioner hinges 274 allow the arm-tension bars 272 to be rotated such that portions thereof at which the sleeve-holding units 276 are positioned are moved far away from each other.

Figure 11:
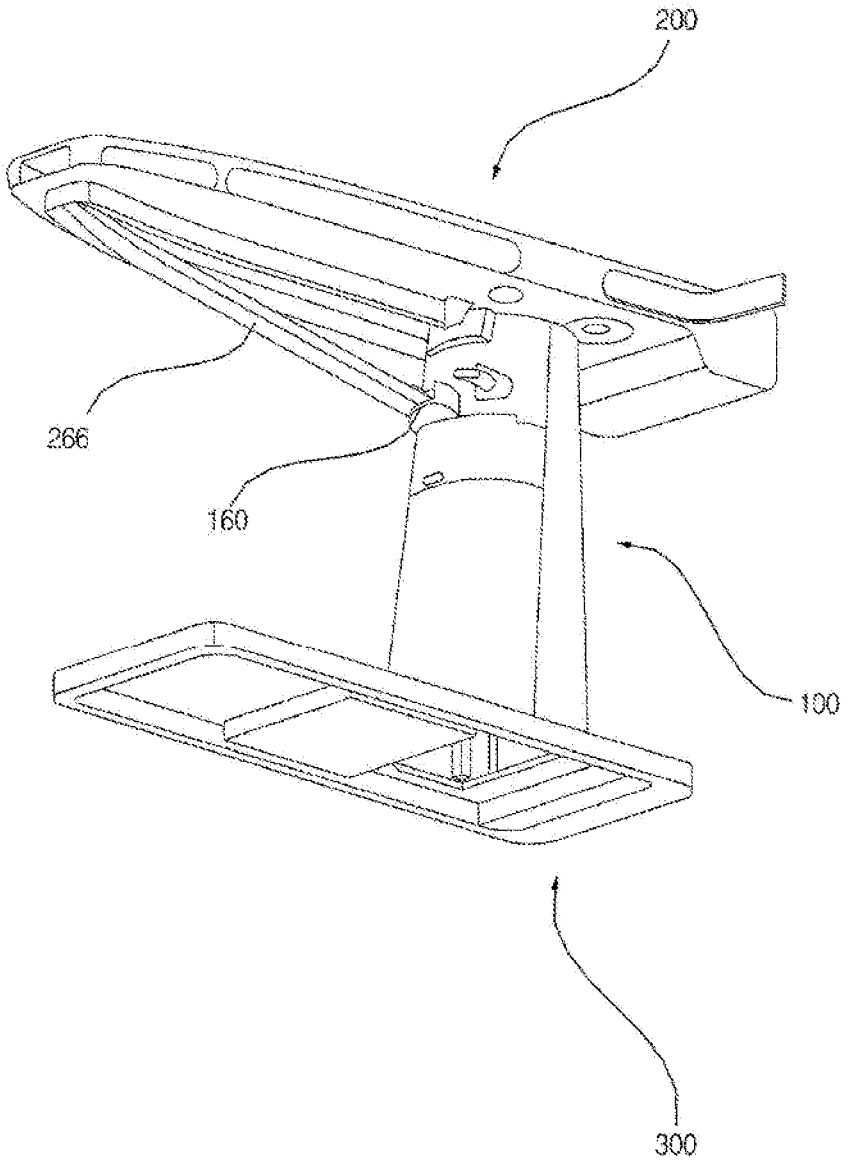
FIG. 11 is a bottom perspective view of the system iron according to an embodiment of the present disclosure, in which a support member is mounted on a support-leg mount.
Figure 12:
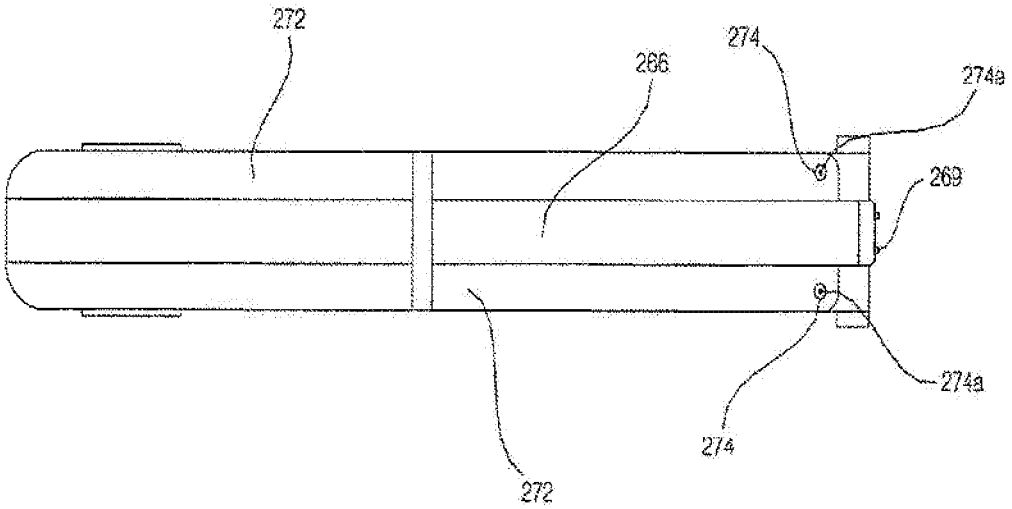
FIG. 12 is a view illustrating a front press, the arm tensioners and a support leg according to an embodiment of the present disclosure.
Figure 13:
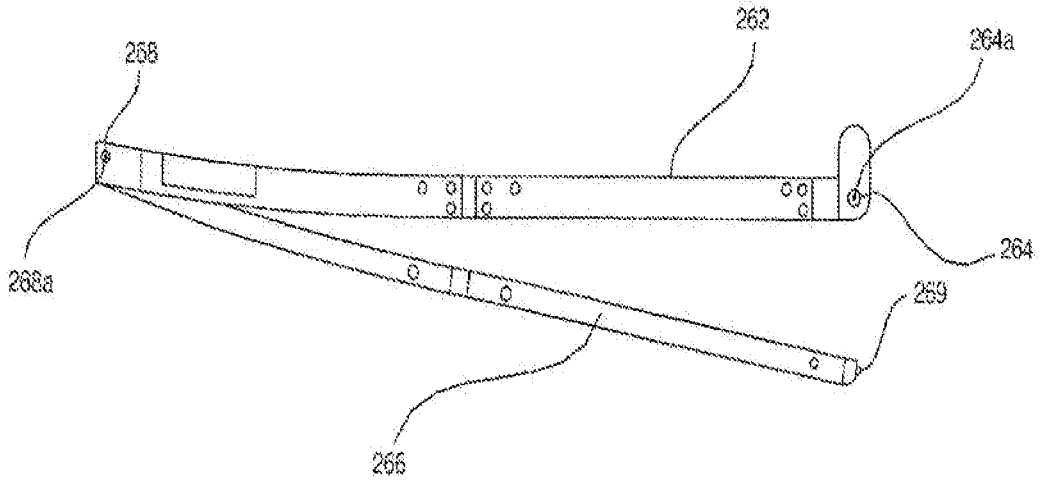
FIG. 13 is a view illustrating a front press, the arm tensioners and a support leg according to an embodiment of the present disclosure.

FIG. 11 is a bottom perspective view of the system iron according to an embodiment of the present disclosure, in which the support member is mounted on the support-leg mount. FIG. 12 is a view illustrating the front press, the arm tensioners and the support leg according to an embodiment of the present disclosure. FIG. 13 is a view illustrating the front press, the arm tensioners and the support leg according to an embodiment of the present disclosure.

The support unit according to the embodiment will be described with reference to FIGS. 11 to 13. The system iron according to the embodiment further includes the support unit for supporting the ironing plate 200 in the ironing mode. The support unit supports the ironing plate 200, which is vertically disposed on the body 100, in the ironing mode. The support unit supports the lower surface 225 of the ironing-plate case 222 in the ironing mode. The support unit connects the lower surface 225 of the ironing-plate case 222 and the support-leg mount formed on a side surface of the upper body 110 in the ironing mode. The support unit supports the clothing-ironing board 210 of the ironing plate 200.

The support unit includes the support leg 266, which supports the ironing plate 200 in the ironing mode, and a support-leg hinge 268, which enables the support leg 266 to be rotated. The support leg 266 is disposed under the press plate 266 of the front press 260 in the height direction H of the ironing plate 200. The support leg 266 according to the embodiment is disposed between the pair of arm tensioners 270. The support-leg hinge 268 is disposed at the front side of the support leg 266 in the longitudinal direction L of the ironing plate 200.

The arm tensioners 270 and the support unit are disposed under the front press 260. When the press plate 262 is rotated about the press-plate hinge 264, the support plate and the arm-tension bars 272 are also rotated with the press plate 262. When the support plate is rotated about the support-plate hinge, the press plate 262 and the arm-tension bars 272 are not rotated. The arm-tension bars 272 are rotated about the arm-tensioner hinges 274, but the press plate 262 or the support plate are not rotated.

The end of the support leg 266 is mounted in the mounting recess 162 in the support-leg mount 160. The support leg 266 includes the holding pins 269, which movably project from the end thereof. The holding pins 269 project outwards from the support leg 266 by virtue of the elastic force of springs disposed in the support leg. When external pressure is applied to the holding pins 269, the holding pins 266 may be moved into the support leg 266. When the support leg 266 is mounted on the support-leg mount 160, the holding pins 269 are inserted into the holding holes (not shown) in the support-leg mount 160, whereby the support leg 266 is stably held on the support-leg mount 160.

The ironing plate 200 includes the neck clip 299, which holds the collar portion of the top in the steam-spraying mode. The neck clip 299 is disposed at the front surface 227 of the ironing plate 200. The neck clip 299 is drawn out of the ironing plate 200 forwards in the longitudinal direction L or is retracted into the ironing plate 200.

The system iron 10 according to the embodiment may further include a base plate 300 for supporting the body 100 and the ironing plate 200. The base plate 300 has a size and a weight such that the ironing plate 200 is stably secured on the body 100 both in the ironing mode and in the steam-spraying mode.

The base plate 300 may further include casters (not shown), which enable the system iron 10 to be easily moved.

Figure 14:
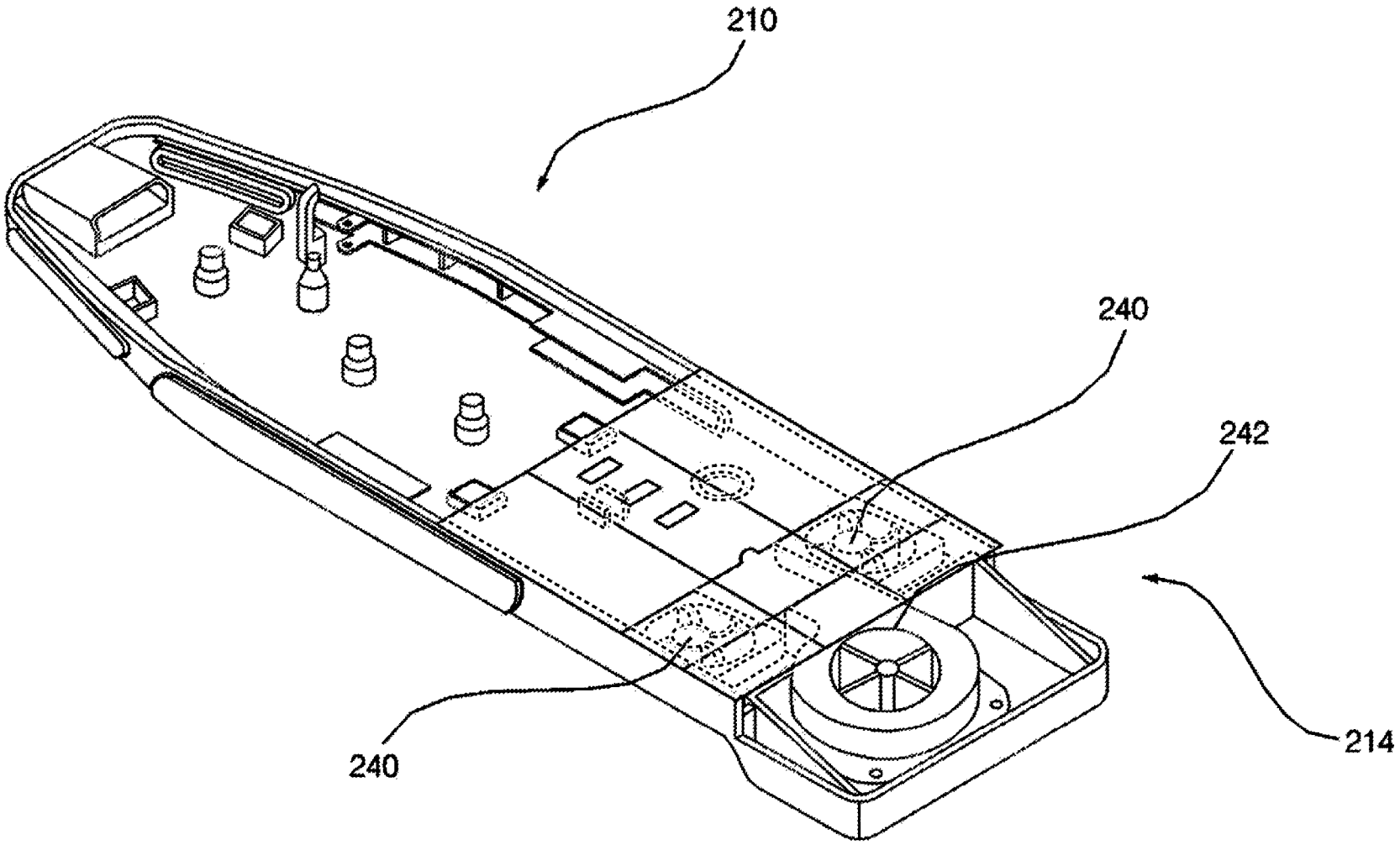
FIG. 14 is a view illustrating the first fan and the second fan, which are disposed in the ironing plate according to an embodiment of the present disclosure.
Figure 15:
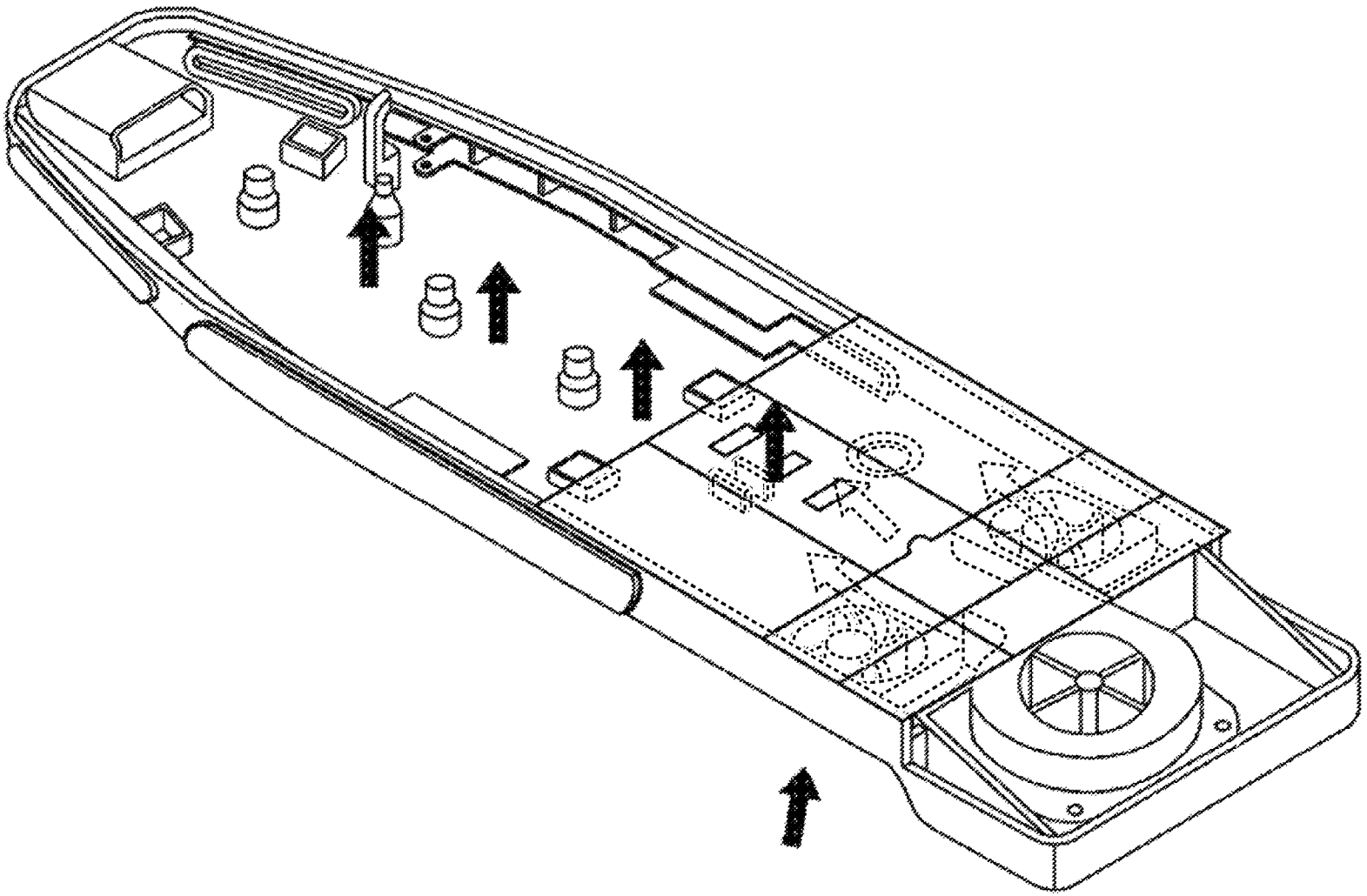
FIG. 15 is a view illustrating the flow of air in the system iron according to an embodiment of the present disclosure in a suction mode.
Figure 16:
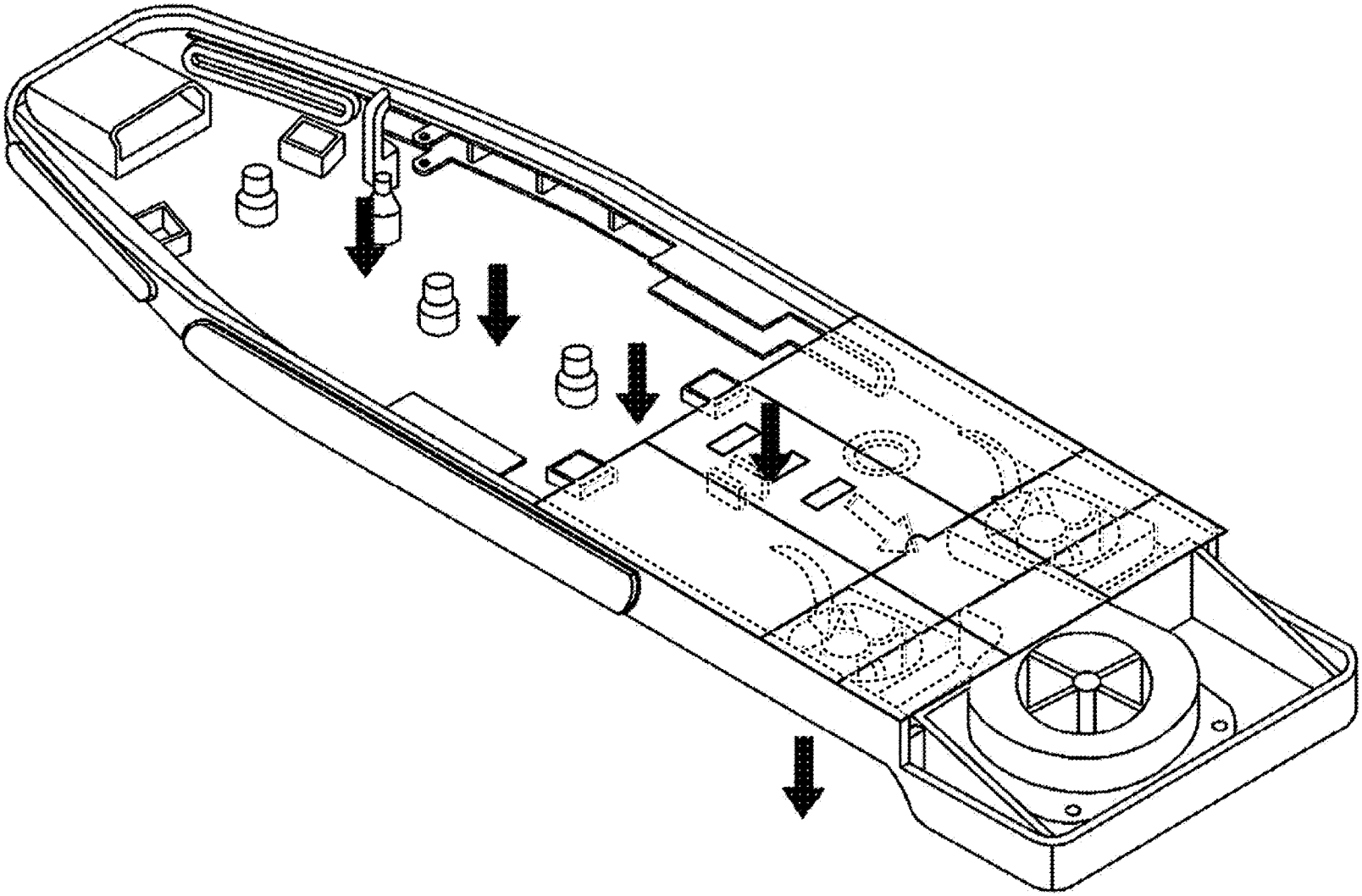
FIG. 16 is a view illustrating the flow of air in the system iron according to an embodiment of the present disclosure in a blowing mode.
Figure 17:
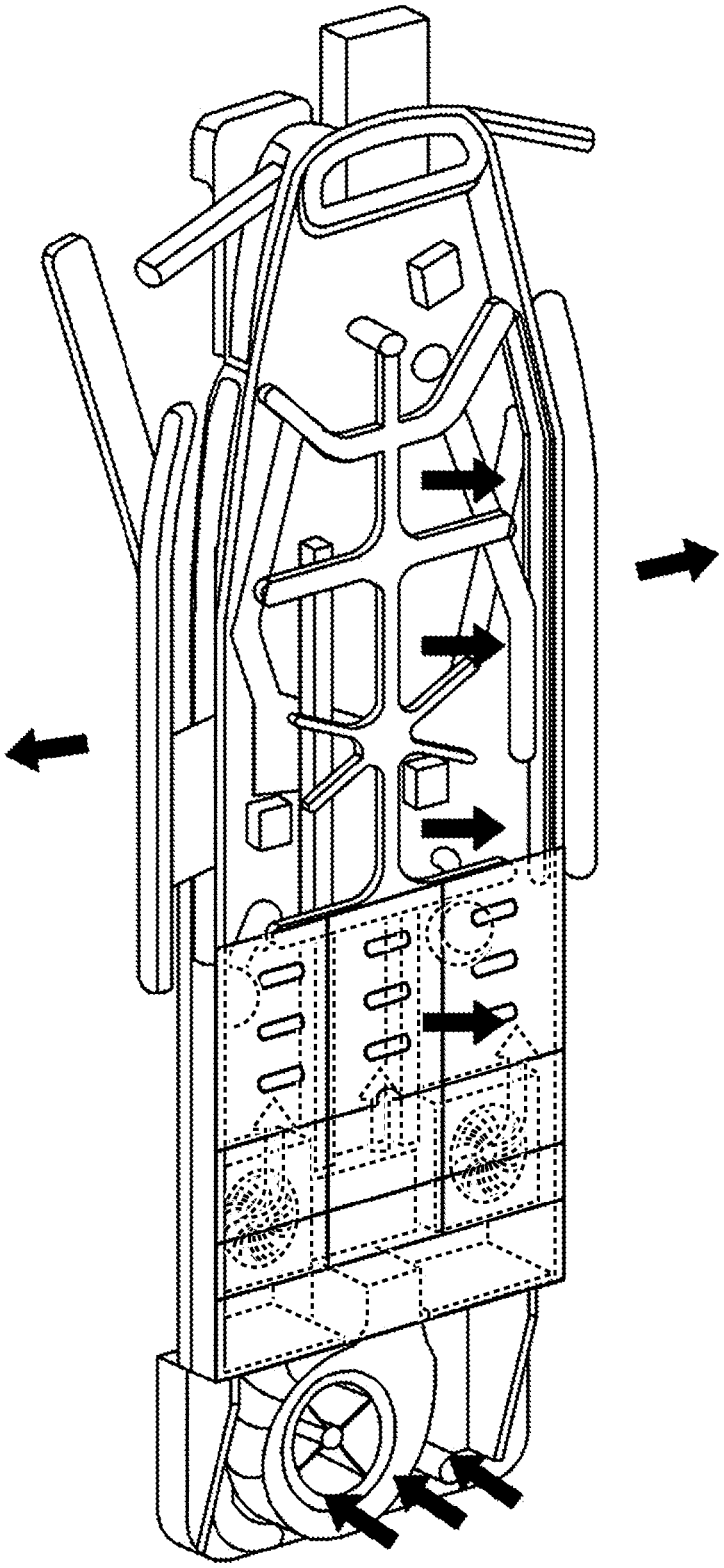
FIG. 17 is a view illustrating the flow of air in the system iron according to an embodiment of the present disclosure in an iron-cooling mode.
Figure 18:
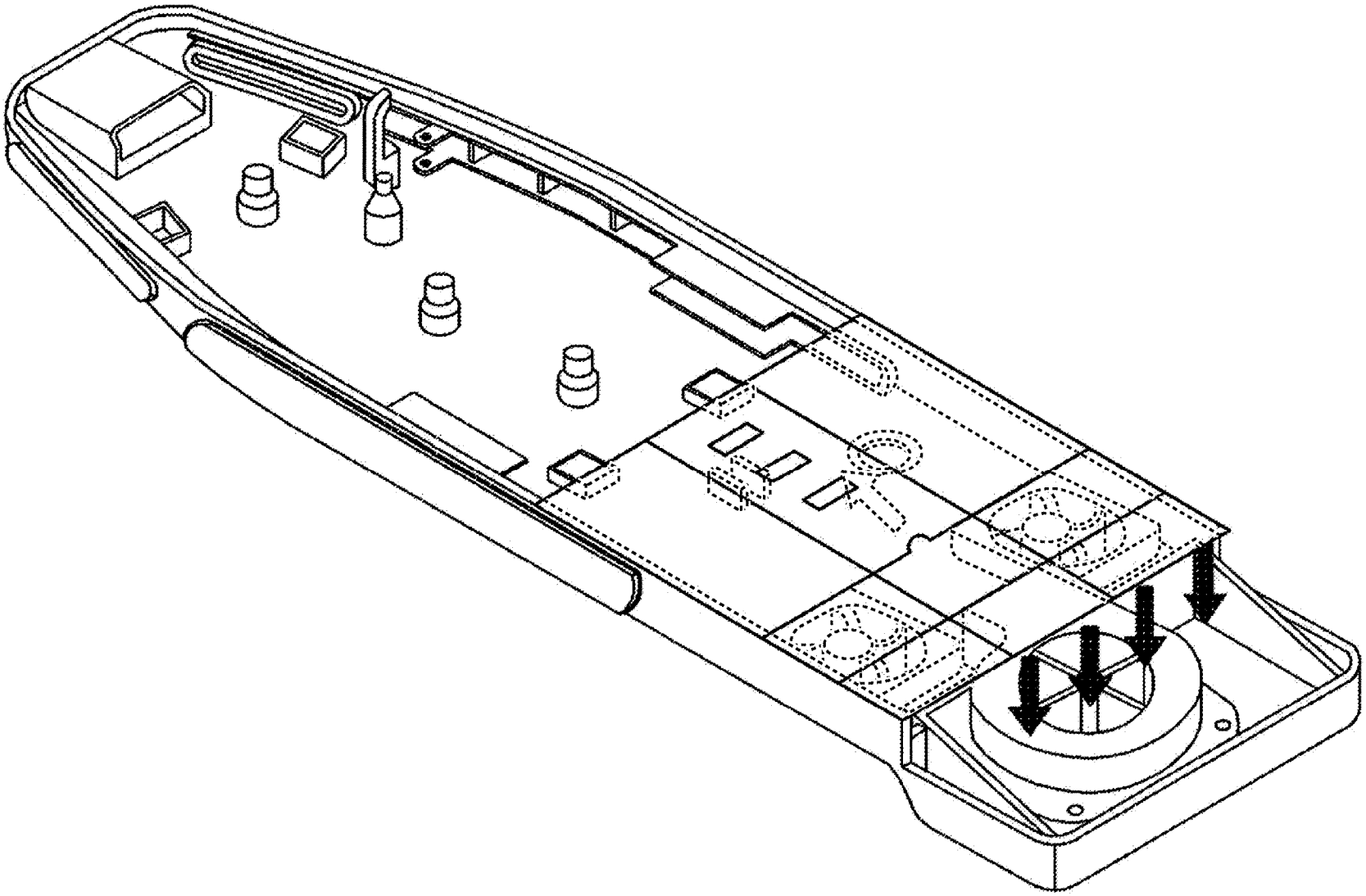
FIG. 18 is a view illustrating flow of air in the system iron according to an embodiment of the present disclosure in a steam-spraying mode.

FIG. 14 is a view illustrating the first fan and the second fan, which are disposed in the ironing plate according to an embodiment of the present disclosure. FIG. 15 is a view illustrating the flow of air in the system iron according to an embodiment of the present disclosure in a suction mode. FIG. 16 is a view illustrating the flow of air in the system iron according to an embodiment of the present disclosure in a blowing mode. FIG. 17 is a view illustrating the flow of air in the system iron according to an embodiment of the present disclosure in an iron-cooling mode. FIG. 18 is a view illustrating the flow of air in the system iron according to an embodiment of the present disclosure in a steam-spraying mode.

Hereinafter, the disposition of the first and second fans and the flow of air caused by the first and second fans will be described with reference to FIGS. 14 to 18.

The system iron according to the embodiment includes the body 100 including therein the steam generator for generating steam; the ironing plate 200, which is rotatably coupled to the upper portion of the body and which includes therein the steam nozzles for spraying the steam generated by the steam generator to the outside; the first fan 240 for discharging air to the outside of the ironing plate or sucking air into the ironing plate; and the second fan 242 for cooling an iron placed on the ironing plate.

The ironing plate 200 includes the first fan 240 for discharging air to the outside of the ironing plate 200 or sucking air into the ironing plate 200; and the second fan 242 for cooling an iron placed on the ironing plate 200.

The first fan 240 is preferably embodied as an axial fan, which serves to cause gas to flow in the axial direction due to rotation of the shaft thereof. The first fan 240 is disposed in the ironing plate 200. The first fan 240 is disposed in the clothing-ironing board 210 of the ironing plate 200. The first fan 240 is disposed in the clothing-ironing board 210 so as to be positioned at the rear side of the ironing plate 200 in the longitudinal direction thereof. The first fan 240 is positioned farther rearward than the front press 260, disposed on the lower surface of the ironing plate 200, in the longitudinal direction of the ironing plate 200. The first fan 240 is positioned behind the side tensioners 280 in the longitudinal direction of the ironing plate 200. The first fan 240 serves to suck air into the clothing-ironing board 210 or to discharge air to the outside of the clothing-ironing board 210. The clothing-ironing board 210 is provided on the upper plane thereof with the clothing-ironing plate 212 having therein the through hole through which air flows. When the first fan 240 is activated, air flows through the through hole in the clothing-ironing plate 212. The first fan 240 may be operated so as to rotate forwards, so that air is discharged to the outside of the ironing plate 200 through the through hole in the clothing-ironing plate 212, and so as to rotated in reverse, so that air is introduced into the ironing plate 200 through the through hole in the clothing-ironing plate 212. The first fan 240 causes a garment to be spaced apart from the clothing-ironing board 210 by a predetermined distance when rotating forwards. The first fan 240 causes the garment to be close to the clothing-ironing board 210 when rotating in reverse.

The lower surface of the clothing-ironing board 210 is provided with the opening hole 246, through which air is sucked into the ironing plate 200 or is discharged from the ironing plate 200 by virtue of activation of the first fan 240. The first fan 240 is disposed in the opening hole 246 formed in the lower surface of the clothing-ironing board 210. When the first fan 240 rotates in the forward direction, air is introduced into the ironing plate 200 through the opening hole 246 and is discharged to the outside of the ironing plate 200 through the through hole. When the first fan 240 rotates in the reverse direction, air is introduced into the ironing plate 200 through the through hole and is discharged to the outside of the ironing plate 200 through the opening hole 246.

The ironing plate 200 includes the guide plate 248, which guides air flow toward the through hole in the clothing-ironing plate 212 when the first fan 240 is activated. The clothing-ironing board 210 is provided therein with the guide plate 248, which guides air flowing in the ironing plate 200 toward the through hole in the clothing-ironing plate 212 when the fan rotates in the forward direction. The guide plate 248 is positioned above the first fan 240 in the ironing plate in the height direction of the ironing plate 200. When the first fan 240 rotates in the forward direction, the air, which is introduced into the ironing plate, flows forwards in the ironing plate 200 in the longitudinal direction of the ironing plate 200 and is discharged to the outside through the through hole in the clothing-ironing plate.

The first fan 240 according to the embodiment includes a pair of first fans. The pair of first fans 240 are disposed in the clothing-ironing board 210 so as to be spaced apart from each other in the width direction. The air that is discharged from the second fan 242 disposed in the iron rest flows through the space between the pair of first fans 240, which are spaced apart from each other.

The second fan 242 according to the embodiment sucks air through the upper surface of the ironing plate. The second fan 242 according to the embodiment is preferably embodied as a sirocco fan because it is able to suck air above the ironing plate 200 and then to cause the air to flow forwards in the ironing plate in the longitudinal direction of the ironing plate 200. The air that is discharged from the second fan 242 flows through the space defined between the pair of first fans 240.

The second fan 242 is disposed in the ironing plate 200. The second fan 242 is disposed in the iron rest 214 of the ironing plate 200. The second fan 242 sucks air through the suction holes formed in the iron-resting plate 216 and causes the air to flow in the clothing-ironing board 210. When the second fan 242 is activated, air around an iron placed on the iron rest 214 is forcibly circulated, thereby rapidly cooling the iron after use thereof. A silicone insulation material is disposed on the iron-resting plate 216.

Hereinafter, the flow of air in the ironing plate 200 due to the first fan 240 or the second fan 242, which is changed depending on the operational mode of the system iron 10, will be described.

In the system iron 10 according to the embodiment, the ironing plate 200 is disposed perpendicular to the body 100 in an ironing mode. In the ironing mode, it is possible to iron a garment placed on the upper surface of the ironing plate 200 using an iron.

In the ironing mode, the system iron according to the embodiment is operated in a suction mode, in which a garment is brought into close contact with the clothing-ironing board 2120 by virtue of activation of the first fan 240, and in a blowing mode, in which the garment is spaced apart from the clothing-ironing board 210 by virtue of activation of the first fan 240. In addition, in the ironing mode, the system iron 10 according to the embodiment may be operated in an iron-cooling mode, in which the iron is cooled by virtue of activation of the second fan 242.

In the suction mode, the first fan rotates in a reverse direction. Referring to FIG. 16, when the first fan rotates in the reverse direction in the suction mode, air is sucked into the through hole in the clothing-ironing plate and is discharged through the opening hole disposed in the lower surface of the clothing-ironing board.

In the blowing mode, the first fan 240 rotates in a forward direction. Referring to FIG. 15, when the first fan 240 rotates in the forward direction in the blowing mode, air is sucked into the opening hole 246 disposed in the lower surface of the clothing-ironing board 210. When the first fan rotates in the forward direction, the air that is sucked into the opening hole 246 flows forwards in the ironing plate 200 by means of the guide plate 248, and is discharged through the through hole in the clothing-ironing plate 212.

In the iron-cooling mode, the second fan 242 is activated. Referring to FIG. 17, when the second fan 242 is activated in the iron-cooling mode, air is sucked into the suction hole formed in the iron-resting plate. By virtue of activation of the second fan 242, the air that is sucked through the iron-resting plate flows in the clothing-ironing board 210 and is discharged to the outside of the ironing plate 200 through the through hole in the clothing-ironing plate 212.

In the system iron according to the embodiment, the ironing plate 200 is disposed parallel to the body 100 in the steam-spraying mode. In the steam-spraying mode, a garment is hung on the ironing plate 200, and steam is sprayed from the end of the steam flow channel disposed in the ironing plate so as to remove wrinkles from the garment.

Referring to FIG. 18, the first fan 240 rotates in a forward direction in the steam-spraying mode. In the steam-spraying mode, the second fan 242 is activated. In the steam-spraying mode, the first fan 240 rotates in the forward direction, and the second fan 242 is activated. In the steam-spraying mode, air is sprayed to the outside of the clothing-ironing board 210 by virtue of activation of the first fan 240 and the second fan 242. In the steam-spraying mode, the air in the ironing plate 200 is discharged through the through hole in the clothing-ironing plate 212 by virtue of activation of the first fan 240 and the second fan 242. In the steam-spraying mode, air is also sprayed through grooves in the lateral side surfaces of the ironing plate, in which the side tensioners and the shoulder tensioners are received.

The invention claimed is:

1. A system iron comprising:

a body including therein a steam generator for generating steam;

an ironing plate, which is rotatably coupled to an upper portion of the body and which includes therein steam nozzles for spraying the steam generated by the steam generator to an outside of the ironing plate;

a pair of side tensioners arranged to be movable in left and right directions from lateral side surfaces of the ironing plate along which the side tensioners are disposed;

the steam nozzles being disposed inside the ironing plate and configured to spray steam generated by the steam generator through openings in the lateral side surfaces of the ironing plate; and a first fan disposed behind the side tensioners in a longitudinal direction of the ironing plate and configured to flow air into the ironing plate.

2. The system iron according to claim 1, wherein the first fan is disposed behind the openings in the lateral side surfaces of the ironing plate in the longitudinal direction of the ironing plate.

3. The system iron according to claim 1, wherein the system iron comprises a guide plate disposed inside the ironing plate and configured to guide the air flowing from the first fan to a front end of the ironing plate along which the openings in the lateral side surfaces of the ironing plate are formed.

4. The system iron according to claim 3, wherein the first fan sucks air through an opening hole formed at the lower side of the ironing plate and flows the air toward the guide plate.

5. The system iron according to claim 1, wherein the ironing plate includes:

a clothing-ironing board including therein the first fan and the steam nozzles; and an iron rest disposed behind the clothing-ironing board in the longitudinal direction of the ironing plate, the iron rest comprising an iron-resting plate having a suction hole formed therein.

6. The system iron according to claim 5, wherein the system iron comprises a second fan disposed inside the iron rest and configured to suck air through the suction hole formed in the iron-resting plate.

7. The system iron according to claim 6, wherein the second fan is configured so that a direction of air suction by the second fan is perpendicular to a direction of discharge of the air by the second fan, and the second fan is configured to discharge air into the clothing-ironing board.

8. The system iron according to claim 6, wherein the first fan includes a pair of first fans spaced apart in the left and right directions, and wherein the second fan is configured to discharge air into a space between the pair of first fans.

9. The system iron according to claim 1, wherein the steam nozzles are disposed inside the ironing plate and configured to spray steam toward the outside of the ironing plate through grooves formed in the lateral side surfaces of the ironing plate.

10. The system iron according to claim 5, wherein the system iron comprises an iron protector rotatably disposed at two side surfaces of the ironing plate and extending upwards relative to the iron rest.

* * * * *